US010518528B2

(12) United States Patent
Terasawa

(10) Patent No.: US 10,518,528 B2
(45) Date of Patent: Dec. 31, 2019

(54) PRINTING CONTROL DEVICE, PRINTING APPARATUS, CONTROL METHOD OF PRINTING CONTROL DEVICE, AND PROGRAM

(71) Applicant: SEIKO EPSON CORPORATION, Tokyo (JP)

(72) Inventor: Hirofumi Terasawa, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/998,536

(22) Filed: Aug. 16, 2018

(65) Prior Publication Data

US 2019/0054736 A1 Feb. 21, 2019

(30) Foreign Application Priority Data

Aug. 17, 2017 (JP) ..... 2017-157438

(51) Int. Cl.
*B41J 2/045* (2006.01)
*B41J 2/21* (2006.01)

(52) U.S. Cl.
CPC ..... *B41J 2/0451* (2013.01); *B41J 2/04551* (2013.01); *B41J 2/04581* (2013.01); *B41J 2/04586* (2013.01); *B41J 2/04593* (2013.01); *B41J 2/2142* (2013.01); *B41J 2/2146* (2013.01)

(58) Field of Classification Search
CPC ..... B41J 2/0451; B41J 2/2146; B41J 2/2142; B41J 2/04551; B41J 2/04593; B41J 2/04581; B41J 2/04586
See application file for complete search history.

(56) References Cited

U.S. PATENT DOCUMENTS

2005/0237352 A1 10/2005 Yoneyama
2008/0314276 A1* 12/2008 Gothait ..... B41J 2/16579 101/484
2011/0222079 A1* 9/2011 Bezenek ..... G06K 15/00 358/1.8
2012/0038709 A1 2/2012 Owaki
2015/0174899 A1* 6/2015 Otokita ..... B41J 2/04588 347/10

FOREIGN PATENT DOCUMENTS

JP 2004-188383 A 7/2004
JP 2012-040702 A 3/2012
WO WO-2005/105452 A1 11/2005

* cited by examiner

*Primary Examiner* — Yaovi M Ameh
(74) *Attorney, Agent, or Firm* — Foley & Lardner LLP

(57) ABSTRACT

Provided is a printer control device that controls a printer that includes an ink jet head unit that has head arrays, in which three or more ink jet heads for ejecting ink from nozzle arrays are aligned in a nozzle array extending direction, the printer control device includes a head control section that causes an ink jet head unit to execute printing without using a designated head that is an ink jet head designated and all ink jet heads aligned on one side in the nozzle array extending direction with reference to the designated head, in a designation mode, in which inhibition of use of the ink jet heads is designated.

10 Claims, 12 Drawing Sheets

PRINTING CONTROL DEVICE, PRINTING APPARATUS, CONTROL METHOD OF PRINTING CONTROL DEVICE, AND PROGRAM

CROSS REFERENCE TO RELATED APPLICATIONS

This application claims priority to Japanese Application No. 2017-157438, filed Aug. 17, 2017; the contents of which are incorporated by reference herein in their entirety.

BACKGROUND

1. Technical Field

The present invention relates to a printing control device, a printing apparatus, a control method of a printing control device, and a program.

2. Related Art

In the related art, a head unit that has a plurality of heads for ejecting ink from nozzle arrays is known (see JP-A-2012-40702, for example). JP-A-2012-40702 discloses a head unit that has a plurality of head arrays (arrays including recording heads), in each of which a plurality of heads are aligned in a first direction (a direction in which nozzle openings are provided in an aligned manner) that is a nozzle array extending direction, in a second direction that intersects the first direction.

Incidentally, a printing apparatus that executes printing by a head unit is known as one provided with a head unit as described in JP-A-2012-40702. There is a case in which use of a head is inhibited for various reasons in this type of printing apparatus. If the printing apparatus executes printing by the head unit without using only the head, the use of which is inhibited, there is a concern that how the ejected ink is dried and thus how the ink is mixed change, which may cause unevenness in drying. The occurrence of the unevenness in drying may lead to degradation of printing quality.

SUMMARY

An advantage of some aspects of the invention is to enable prevention of occurrence of unevenness in drying and suppression of degradation of printing quality.

According to an aspect of the invention, there is provided a printing control device that controls a printing apparatus provided with a head unit that has head arrays, in which three or more heads for ejecting ink from nozzle arrays are aligned in a first direction that is a nozzle array extending direction, the device including: a printing control section that causes the head unit to execute printing without using a designated head that is a head designated and all heads aligned at least one side in the first direction with reference to the designated head, in a designation mode, in which inhibition of use of the head is designated.

In this case, since the printing control section causes the head unit to execute printing without using the designated head and all the heads aligned at least on one side in the first direction with reference to the designated head, it is possible to prevent occurrence of unevenness in drying and to suppress degradation of printing quality.

The printing control device may further include: an error detection section that detects an error of a head; and a designation section that designates the head with the error as the designated head for the printing control section in a case in which the error detection section detects the error.

In this case, since the head unit is caused to execute printing without using all the heads aligned in the first direction including the head with the error, it is possible to prevent occurrence of unevenness in drying due to the head with the error and to suppress degradation of printing quality.

In the printing control device, in a case in which all the heads aligned on one side in the first direction with reference to the designated head are not used, the printing control section may cause the head unit to execute printing without using all the heads aligned on the side in the first direction, the number of which aligned in the first direction from the designated head is the smallest.

In this case, since the head unit is caused to execute printing without using all the heads aligned in the first direction, the number of which aligned in the first direction from the designated head is the smallest, in a case in which all the heads aligned on one side in the first direction with reference to the designated head are not used, it is possible to secure more heads to be used for the printing and to suppress degradation of a printing speed while suppressing degradation of printing quality.

In the printing control device, the first direction may include a transport direction in which a printing medium is transported, and in a case in which all the heads aligned on the one side in the first direction with reference to the designated head are not used, the printing control section may cause the head unit to execute printing without using all the heads aligned on an upstream side of the designated head in the transport direction.

In this case, since the head unit is caused to execute printing without using all the heads aligned on the upstream side of the designated head in the transport direction in a case in which all the heads aligned on one side in the first direction with reference to the designated head are not used, it is possible to suppress extension of a drying time of the ejected ink and to reduce a difference between printing quality achieved in a case in which a part of the heads is not used and printing quality achieved in a case in which all the heads are used.

In the printing control device, the head unit may have the plurality of head arrays aligned in a second direction that intersects the first direction, and the printing control section may cause the head unit to execute printing without using all the heads aligned in the first direction including the designated head and all the heads aligned on one side in the second direction with reference to the designated head.

In this case, since the head unit is caused to execute printing without using all the heads aligned in the first direction including the designated head and all the heads aligned on one side in the second direction with reference to the designated head, it is possible to prevent occurrence of unevenness in drying and to suppress degradation of printing quality.

In the printing control device, the head unit may have the plurality of head arrays for each color, and in a case in which all the heads aligned in the first direction including the designated head and all the heads aligned on one side in the second direction with reference to the designated head are not used, the printing control section may cause the head unit to execute printing without using the heads such that at least one head array remains for each color.

In this case since the head unit is caused to execute printing without using the heads such that at least one head array remains for each color in a case in which all the heads aligned in the first direction including the designated head and all the heads aligned on one side in the second direction with reference to the designated head are not used, it is possible to prevent occurrence of colors that are not formed, to prevent occurrence of unevenness in drying, and to suppress degradation of printing quality.

In the printing control device, in a case in which printing quality is in first setting in the designation mode, the printing control section may cause the head unit to execute printing without using all the heads aligned at least on one side in the first direction with reference to the designated head, and in a case in which the printing quality is in second setting that is lower than the first setting in the designation mode, the printing control section may cause the head unit to execute without using only the designated head.

In this case, since the printing is executed without using all the heads aligned at least on one side in the first direction with reference to the designated head in a case in which the printing quality is in the first setting, and the printing is executed without using only the designated head in the case of the second setting, it is possible to suppress degradation of printing quality and degradation of a printing speed in accordance with the set printing quality.

In the printing control device, the heads may include drive elements that cause ink to be ejected from the nozzles that form the nozzle arrays, and the printing control section may cause the drive elements provided in the heads, which are not used, other than the designated head to minutely vibrate.

In this case, since at least the drive elements included in the heads, which are not used, other than the designated head are caused to minutely vibrate, it is possible to suppress occurrence of an error in the heads, which are not used, other than the designated head, and to suppress an increase in heads with errors.

According to another aspect of the invention, there is provided a printing apparatus including: a head unit that has head arrays, in which three or more heads for ejecting ink from nozzle arrays are aligned in a first direction that is a nozzle array extending direction; and a printing control device that has a printing control section that causes the head unit to execute printing without using a designated head that is a head designated and all the heads aligned at least on one side in the first direction with reference to the designated head, in a designation mode, in which inhibition of use of the head is designated.

In this case, since the printing control section causes the head unit to execute printing without using the designated head and all the heads aligned at least on one side in the first direction with reference to the designated head, it is possible to prevent occurrence of unevenness in drying and to suppress degradation of printing quality.

According to still another aspect of the invention, there is provided a control method of a printing control device that controls a printing apparatus provided with a head unit that has head arrays, in which three or more heads for ejecting ink from nozzle arrays are aligned in a first direction that is a nozzle array extending direction, the method including: causing the head unit to execute printing without using a designated head that is a head designated and all heads aligned at least on one side in the first direction with reference to the designated head, in a designation mode, in which inhibition of use of the head is designated.

In this case, since the printing control section causes the head unit to execute printing without using the designated head and all the heads aligned at least on one side in the first direction with reference to the designated head, it is possible to prevent occurrence of unevenness in drying and to suppress degradation of printing quality.

According to still another aspect of the invention, there is provided a program that can be executed by a control section in a printing control device that controls a printing apparatus provided with a head unit that has head arrays, in which three or more heads for ejecting ink from nozzle arrays are aligned in a first direction that is a nozzle array extending direction, the program causes the control section to: cause the head unit to execute printing without using a designated head that is a head designated and all heads aligned on at least one side in the first direction with reference to the designated head, in a designation mode, in which inhibition of use of the head is designated.

In this case, since the printing control section causes the head unit to execute printing without using the designated head and all the heads aligned on one side in the first direction with reference to the designated head, it is possible to prevent occurrence of unevenness in drying and to suppress degradation of printing quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
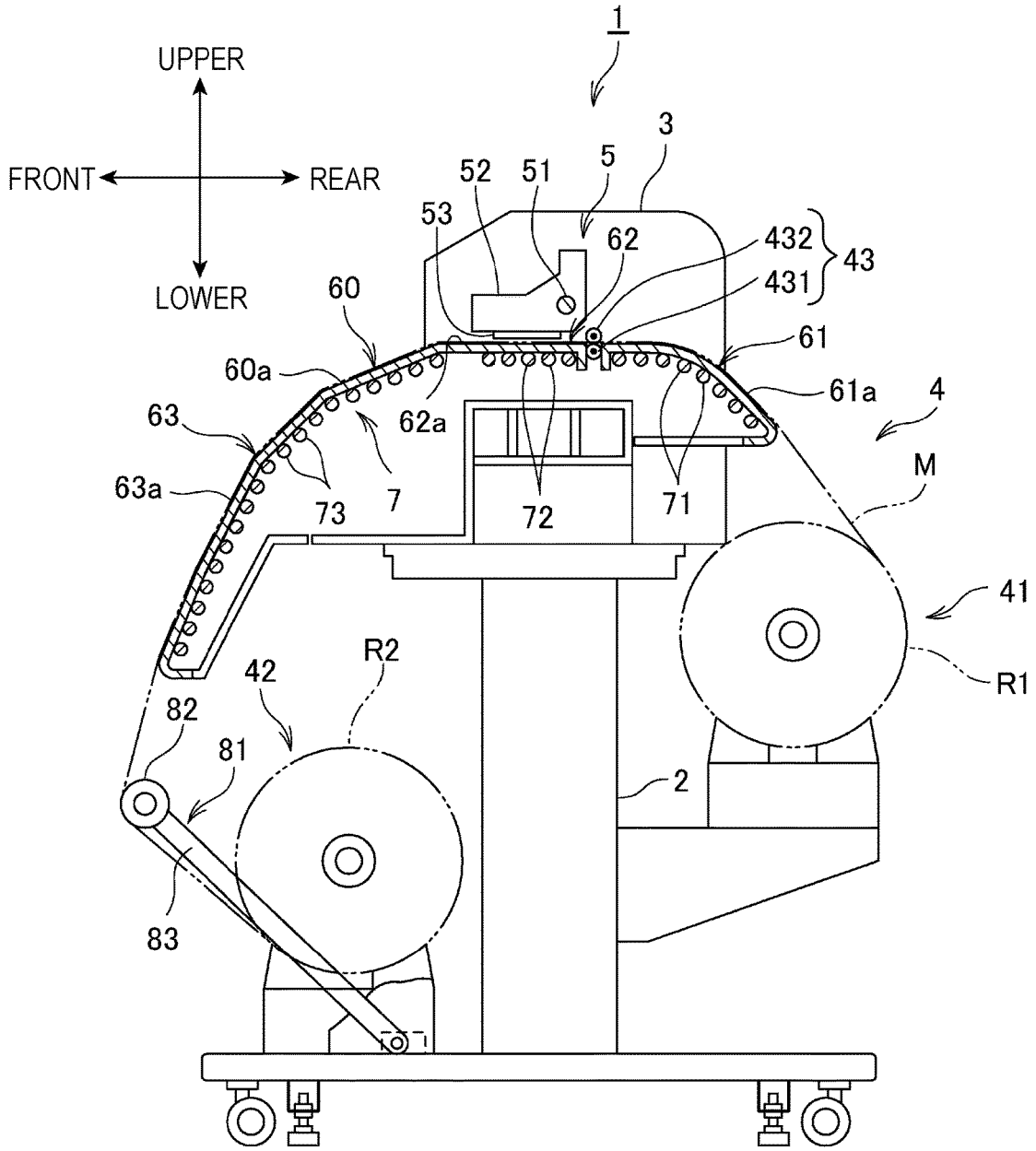
FIG. 1 is a diagram illustrating configurations of main parts of a printer.

FIG. 1 is a diagram illustrating a configuration of main parts in a printer 1 (printing apparatus).

In description using FIG. 1, the direction to the left side in the drawing is assumed to be the "front side". The direction to the right side in the drawing is assumed to be the "rear side". The direction to the upper side in the drawing is assumed to be the "upper side". The direction to the lower side in the drawing is assumed to be the "lower side". In the embodiment, the front side corresponds to a transport direction H (see FIG. 2) in which a medium M (printing medium) is transported when ink is ejected from an ink jet head HD (see FIG. 2) toward the medium M while the rear side is a direction opposite to the front side. Also, the lower side is a gravity direction when the printer 1 is installed while the upper side is a direction opposite to the lower side.

The printer 1 is an apparatus that prints characters, images, and the like by ejecting ink onto the medium M in an ink jet scheme and is a large format printer (LFP) that executes printing on a relatively large medium M. The medium M is a printing medium with a width of about 64 inches, for example.

As illustrated in FIG. 1, the printer 1 includes a seating 2 that has a plurality of wheels at a lower end and a substantially rectangular parallelepiped main body 3 that is supported on the seating 2.

The printer 1 includes a transport section 4 that transports the medium M in a roll-to-roll scheme.

The transport section 4 has a feeding section 41 that feeds the medium M from a roll body R1, around which the long medium M is wound in a roll shape, to the main body 3 and a winding section 42 that winds the medium M after printing, which is fed from a discharge port on the front side of the main body 3 by the feeding section 41, around a roll body R2.

In addition, the transport section 4 has a transport roller pair 43 that transports the medium M in a pinched state through a transport route between the feeding section 41 and the winding section 42. The transport roller pair 43 includes a transport roller 431 that is arranged below the transport route and rotates and a transport roller 432 that is arranged above the transport route and rotates in accordance with the rotation of the transport roller 431. The transport roller pair 43 transports the medium M through the rotation of the transport roller 431 and the transport roller 432.

The printer 1 includes a printing section 5 that prints characters, images, and the like by ejecting ink onto the medium M.

The printing section 5 includes a carriage 52 that reciprocates in an intersecting direction Y (see FIG. 2) (second direction) (for example, a perpendicularly intersecting direction) (a direction perpendicularly intersecting the paper face in FIG. 1) that intersects the transport direction H of the medium M along a guide shaft 51 that is stretched in the main body 3. The carriage 52 mounts an ink jet head unit 53 (head unit) at a position at which the ink jet head unit 53 faces the medium M. In more detail, the ink jet head unit 53 is mounted on the carriage 52 such that nozzle openings, from which the ink is ejected, face the medium M.

Figure 2:
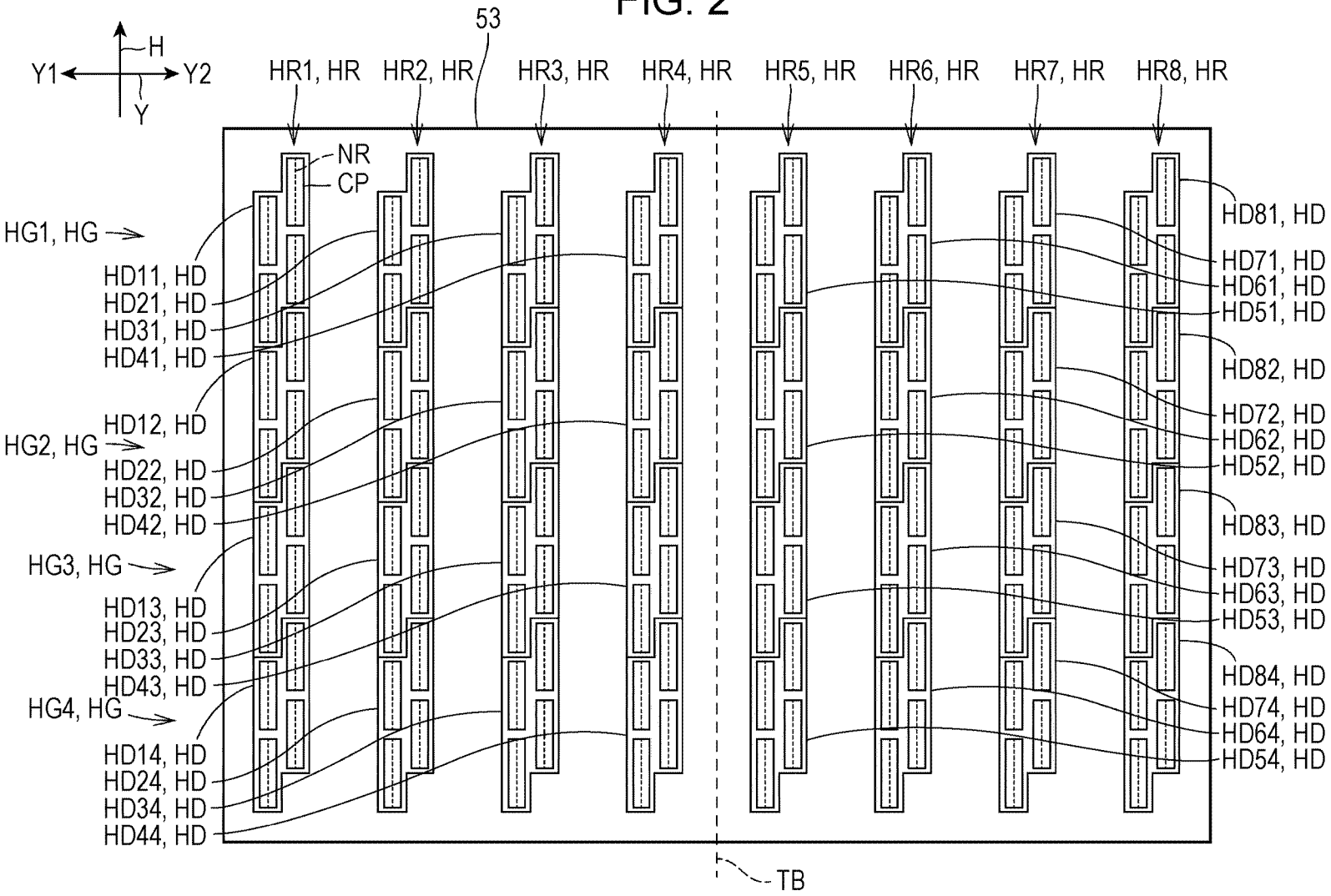
FIG. 2 is a diagram illustrating an example of an ink jet head.

FIG. 2 is a diagram illustrating an example of the ink jet head unit 53.

As illustrated in FIG. 2, the ink jet head unit 53 has a head array HR1, a head array HR2, a head array HR3, a head array HR4, a head array HR5, a head array HR6, a head array HR7, and a head array HR8 aligned in this order from a direction Y1 to a direction Y2 in the intersecting direction Y.

In a case in which one head array is indicated without distinguishing the head arrays HR1 to HR8, the head array will be expressed as a head array HR in the following description.

The head array HR includes three or more (four in the embodiment) ink jet heads HD (heads) aligned in the transport direction H of the medium M. Note that a direction including the transport direction H and the direction opposite to the transport direction H corresponds to the direction (first direction) in which nozzle arrays NR extend. In a case in which one ink jet head is indicated without distinguishing the ink jet heads HD11 to HD84, the ink jet head is expressed as an ink jet head HD in the following description.

The ink jet head HD has a plurality of chips CP provided with nozzle arrays NR extending in the transport direction H. As illustrated in FIG. 2, the ink jet head HD has four chips CP such that two chip arrays, each of which include two chips CP aligned in the transport direction H, are arranged so as to slightly deviate in the transport direction H and be aligned in the intersecting direction Y. That is, the ink jet head HD has four chips CP arranged in a zigzag manner.

Ejection ports corresponding to the number of nozzles included in the nozzle arrays NR are provided in faces, which face the medium M, of the chips CP such that the ink can be ejected from the respective ejection ports. Note that the ejection ports corresponding to the nozzle openings. Ink chambers to which ink is supplied from ink tanks accommodated in an ink tank accommodation section that is not illustrated in the drawing are connected to the respective ejection ports. Piezoelectric elements (drive elements) are provided in the respective ink chambers.

Each piezoelectric element is deformed if a voltage is applied thereto and pressurizes and depressurizes the corresponding ink chamber. If the ink chamber is pressurized by the piezoelectric element, the ink is ejected from the ejection port. Meanwhile, if the ink chamber is depressurized by the piezoelectric element, the ink is supplied from the ink tank. Each piezoelectric element has a different amount of deformation in accordance with a voltage value of the voltage applied. Therefore, it is possible to adjust force, a timing, and the like of the pressurization of the ink chamber by appropriately controlling the voltage applied to the piezoelectric element, and the printer 1 can change the size of the ejected ink.

The head array HR1 has ink jet heads HD11 to HD14 aligned in the order of the ink jet head HD11, the ink jet head HD12, the ink jet head HD13, and the ink jet head HD14 in a direction opposite to the transport direction H. In the embodiment, the head array HR1 ejects cyan (C) ink. That is, the respective ink jet heads HD11 to HD14 eject the cyan (C) ink from the nozzle arrays NR.

The head array HR2 has ink jet heads HD21 to HD24 in the order of the ink jet head HD21, the ink jet head HD22, the ink jet head HD23, and the ink jet head HD24 aligned in a direction opposite to the transport direction H. In the embodiment, the head array HR2 ejects magenta (M) ink. That is, the respective ink jet heads HD21 to HD24 eject the magenta (M) ink from the nozzle arrays NR.

The head array HR3 has ink jet heads HD31 to HD34 in the order of the ink jet head HD31, the ink jet head HD32, the ink jet head HD33, and the ink jet head HD34 in the direction opposite to the transport direction H. In the embodiment, the head array HR3 ejects yellow (Y) ink. That is, the ink jet heads HD31 to HD34 eject the yellow (Y) ink from the nozzle arrays NR.

The head array HR4 has ink jet heads HD41 to HD44 in the order of the ink jet head HD41, the ink jet head HD42, the ink jet head HD43, and the ink jet head HD44 in the direction opposite to the transport direction H. In the embodiment, the head array HR4 ejects the black (K) ink. That is, the respective ink jet heads HD41 to HD44 the black (K) ink from the nozzle arrays NR.

The head array HR5 has ink jet heads HD51 to HD54 in the order of the ink jet head HD51, the ink jet head HD52, the ink jet head HD53, and the ink jet head HD54 in the direction opposite to the transport direction H. In the embodiment, the head array HR5 ejects black ink (K). That is, the respective ink jet heads HD51 to HD54 eject the black (K) ink from the nozzle arrays NR.

The head array HR6 has ink jet heads HD61 to HD 64 in the order of the ink jet head HD61, the ink jet head HD 62, the ink jet head HD63, and the ink jet head HD64 in the direction opposite to the transport direction H. In the embodiment, the head array HR6 ejects yellow (Y) ink. That is, the respective ink jet heads HD61 to HD64 eject the yellow (Y) ink from the nozzle arrays NR.

The head array HR7 has ink jet heads HD71 to HD74 in the order of the ink jet head HD71, the ink jet head HD72, the ink jet head HD73, and the ink jet head HD74 in the direction opposite to the transport direction H. In the embodiment, the head array HR7 ejects magenta (M) ink. That is, the respective ink jet heads HD71 to HD74 eject the magenta (M) ink from the nozzle arrays NR.

The head array HR8 has ink jet heads HD81 to HD84 in the order of the ink jet head HD81, the ink jet head HD82, the ink jet head HD83, and the ink jet head HD84 in the direction opposite to the transport direction H. In the embodiment, the head array HR8 ejects cyan (C) ink. That is, the respective ink jet heads HD81 to HD84 ejects the cyan (C) ink from the nozzle arrays NR.

In this manner, the ink jet head unit 53 has the head arrays HR that ejects the ink with corresponding colors in the order of cyan (C), magenta (M), yellow (Y), black (K), black (K), yellow (Y), magenta (M), and cyan (C) from the direction Y1 to the direction Y2 in the interesting direction Y. That is, the ink jet head unit 53 has the head arrays HR with different colors such that the head arrays HR are linearly asymmetric with respect to a substantially central portion TB in the intersecting direction Y. As will become obvious from the following description, the printer 1 according to the embodiment can execute printing by ejecting the ink from the ink jet head unit 53 while heating the medium M. By linearly asymmetrically arranging the head arrays HR in terms of the colors as described above, it is possible to cause orders of the colors of the ejected ink to be the same both in the case in which the carriage 52 moves in the direction Y1 and in the case in which the carriage 52 moves in the direction Y2. In generally, the ink with different colors has different degrees of drying. Therefore, the printer 1 can suppress occurrence of unevenness in drying by causing the orders of the colors of the ejected ink to be the same both in the case in which the carriage 52 moves in the direction Y1 and in the case in which the carriage 52 moves in the direction Y2.

Note that although the configuration in which the ink jet head unit 53 ejects the ink of the four colors, namely cyan (C), magenta (M), yellow (Y), and black (K) in the embodiment, the colors of the ejected ink are not limited to these four colors, and the number of the colors may be larger or smaller. However, the ink jet head unit 53 has the head arrays HR for ejected ink with different colors such that the head arrays HR are linearly asymmetric with respect to the substantially central portion TB in the intersecting direction Y.

As illustrated in FIG. 2, the ink jet head unit 53 has a head row HG1, a head row HG2, a head row HG3, and a head row HG4 in this order in the direction opposite to the transport direction H. In a case in which one head row is indicated without distinguishing the head row HG1, the head row HG2, the head row HG3, and the head row HG4, the one head row is expressed as a head row HG in the following description.

The head row HG1 has an ink jet head HD11, an ink jet head HD21, an ink jet head HD31, an ink jet head HD41, an ink jet head HD51, an ink jet head HD61, an ink jet head HD71, and an ink jet head HD81 in this order from the direction Y1 to the direction Y2 in the intersecting direction Y.

The head row HG2 has an ink jet head HD12, an ink jet head HD22, an ink jet head HD32, an ink jet head HD42, an ink jet head HD52, an ink jet head HD62, an ink jet head HD72, and an ink jet head HD82 in this order from the direction Y1 to the direction Y2 in the interesting direction Y.

The head row HG3 has an ink jet head HD13, an ink jet head HD23, an ink jet head HD33, an ink jet head HD43, an ink jet head HD53, an ink jet head HD63, an ink jet head HD73, and an ink jet head HD83 in this order from the direction Y1 to the direction Y2 in the intersecting direction Y.

The head row HG4 has an ink jet head HD14, an ink jet head HD24, an ink jet head HD34, an ink jet head HD44, an ink jet head HD54, an ink jet head HD64, an ink jet head HD74, and an ink jet head HD84 in this order from the direction Y1 to the direction Y2 in the intersecting direction Y.

In this manner, the ink jet head unit 53 includes the plurality of ink jet heads HD, ejects the ink from the nozzle arrays NR of the ink jet heads HD, and executes printing on the medium M when the carriage 52 moves in the intersecting direction Y.

Returning to the description of FIG. 1, a support member 60 that has a support surface 60*a* that curves the medium M to protrude upward and supports the medium M is provided between the feeding section 41 and the winding section 42. The support member 60 includes a plurality of assembled members with predetermined shapes that are formed by performing bending working on plate members such as metal plates.

The support member 60 has a feeding support section 61 that supports the medium M, which has been sent from the roll body R1, on an upstream side of the printing section 5 along the transport route, a printing support section 62 that is provided at a position at which the printing support section 62 faces the printing section 5 and supports a portion that is a printing region in the medium M, and a discharge support section 63 that supports the medium M after the printing on the downstream side of the printing section 5 along the transport route.

The feeding support section 61 has a support surface 61*a* that includes an inclined transport surface that is higher toward the downstream side of the transport route. The medium M fed from the roll body R1 is transported to the printing section 5 in a state in which the medium M is supported by the support surface 61*a*.

In addition, the printing support section 62 has a support surface 62*a* that is parallel with a surface, in which nozzles in the ink jet head unit 53 are opened, in a state in which a predetermined gap is provided from the surface.

The discharge support section 63 forms the transport route between the printing section 5 and the winding section 42 and extends while curving to be lowered toward the downstream side of the transport route and protrude outward (on the front side in FIG. 1). The discharge support section 63 has a support surface 63*a* that supports the medium M in a state in which the medium M is curved. The respective support sections 61, 62, and 63 are arranged such that the respective support surfaces 61*a*, 62*a*, and 63*a* are continuously coupled substantially in a plane.

As illustrated in FIG. 1, a heating section 7 that heats the support surface 60*a* is provided on the rear side of the support member 60.

More specifically, a pre-heater 71 that heats the support surface 61*a* is arranged on the rear side of the feeding support section 61. The pre-heater 71 preheats the medium M on the support surface 61*a*. In addition, a platen heater 72 that heats the support surface 62*a* that faces the printing section 5 is arranged on the rear side of the printing support section 62. In addition, a post-heater 73 that heats the support surface 63*a* is installed on the rear side of the discharge support section 63. The post-heater 73 dries the ink by heating the medium M on the support surface 63*a*. The heating section 7 with such a configuration can quickly dry and fix the ink on the medium M by heating the medium M, prevent bleeding, blur, and the like, and improve printing quality.

A tensile force applying mechanism 81 that applies tensile force to the medium M is provided below the end of the discharge support section 63 on the downstream side. The tensile force applying mechanism 81 has a tension roller 82 that is brought into contact with the medium M between the discharge support section 63 and the winding section 42 and applies pressing force thereto. The tension roller 82 is rotationally supported by tip ends of a pair of arm members, which have base ends supported by the seating 2 so as to be able to be turned, and has an axial length that is longer than the width of the medium M in the width direction (a direction perpendicularly intersecting the paper face in FIG. 1). The medium M is wound around the roll body R2 in a state in which tension in accordance with the weight of the tension roller 82 is applied on the downstream side of the discharge support section 63.

Next, a functional configuration of the printer 1 will be described.

Figure 3:
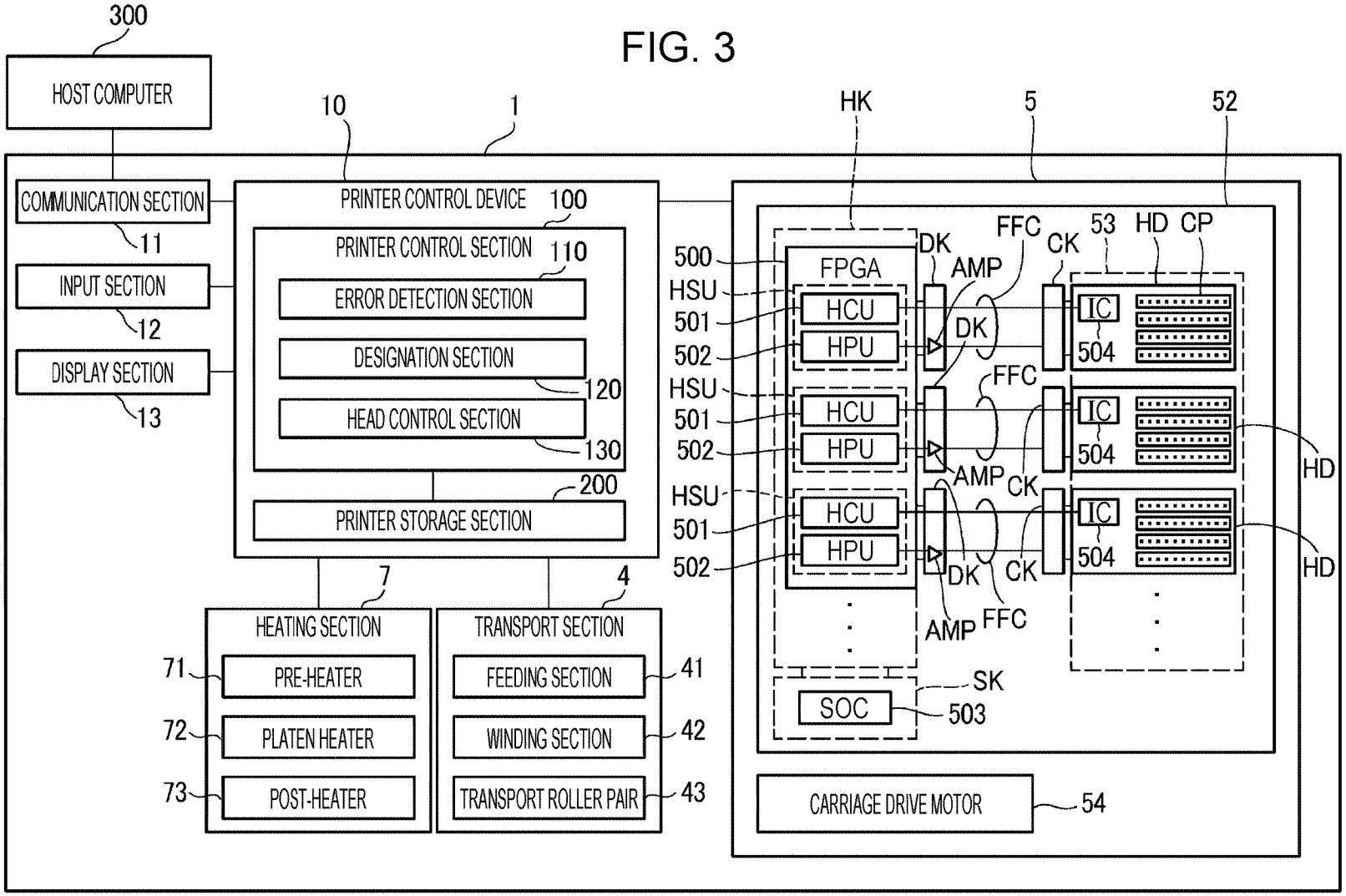
FIG. 3 is a diagram illustrating a functional configuration of a printer.

FIG. 3 is a diagram illustrating the functional configuration of the printer 1.

As illustrated in FIG. 3, the printer 1 includes a printer control device 10 (printing control device), a communication section 11, an input section 12, a display section 13, a heating section 7, a transport section 4, and a printing section 5.

The printer control device 10 is a device that controls the respective parts of the printer 1 and includes a printer control section 100 (control section) and a printer storage section 200.

The printer control section 100 includes a CPU, a ROM, a RAM, an ASIC, a signal processing circuit, and the like and controls the respective parts of the printer 1. The printer control section 100 executes processing by hardware and software, and for example, the CPU reads programs stored in the ROM, the printer storage section 200, which will be described later, and the like in the RAM, executes processing, and processing is executed by functions mounted on the ASIC, for example. The printer control section 100 includes an error detection section 110, a designation section 120, and a head control section 130 (printing control section) as functional blocks. These functional blocks execute the processing through cooperation of the hardware and the software by the hardware such as the CPU reading the programs stored in the printer storage section 200, the ROM, and the like and executing the processing. These functional blocks will be described later.

The printer storage section 200 includes nonvolatile memories such as a hard disk, an EEPROM, and a solid state drive (SSD) and stores various kinds of data in a rewritable manner.

The communication section 11 communicates with a host computer 300 in accordance with predetermined communication standards under control performed by the printer control section 100.

The input section 12 includes input mechanisms such as an operation switch and a touch panel provided in the printer 1, detects operations performed by a user on the input mechanisms, and outputs the operations to the printer control section 100. The printer control section 100 executes processing corresponding to the operations performed on the input mechanisms on the basis of the inputs from the input section 12.

The display section 13 includes a plurality of LEDs, a display panel, and the like and executes turning on/off of the LEDs in a predetermined form, display of information on the display panel, and the like under control of the printer control unit 100.

The heating section 7 includes the pre-heater 71, the platen heater 72, and the post-heater 73 as described above and heats the transported medium M under control performed by the printer control section 100. As described above, the pre-heater 71 preheats the medium M on the support surface 61*a*. In addition, the platen heater 72 heats the medium M on the support surface 62*a*. Also, the post-heater 73 heats the medium M on the support surface 63*a*.

The transport section 4 includes the feeding section 41, the winding section 42, and the transport roller pair 43 as described above, and other configurations regarding transport of the medium M. The transport section 4 transports at least the medium M in the transport direction H under control performed by the printer control section 100.

The printing section 5 includes the carriage 52 as described above, the ink jet head unit 53 that is mounted on the carriage 52, a drive circuit (not illustrated) that drives the ink jet head unit 53, a carriage drive motor 54 that causes the carriage 52 to scan in the intersecting direction Y, and other configurations regarding printing on the medium M. The printing section 5 prints characters, images, and the like on the medium M under control performed by the printer control section 100.

In particular, a carriage control substrate SK and a head control substrate HK in addition to the ink jet head unit 53 are mounted on the carriage 52. The carriage control substrate SK and the head control substrate HK are connected by a board-to-board connector (BTB connector).

The carriage control substrate SK includes a system-on-chip (SOC) 500. The SOC 500 is an integrated circuit that controls the respective parts of the carriage 52, and in particular, controls the head control substrate HK. For example, in a case in which the SOC 500 acquires an encoded signal in conjunction with movement of the carriage 52 in the intersecting direction Y, the SOC 500 outputs the encoded signal to the printer control section 100. In addition, the SOC 500 controls the head control substrate HK on the basis of an ink ejection timing generated by the printer control section 100 on the basis of the input encoded signal under control performed by the printer control section 100 and controls the ink ejection timing of the ink jet head unit 53.

The head control substrate HK includes a plurality of FPGAs 500. One FPGA 500 includes a plurality of (three in the embodiment) head control units HSU. A drive substrate DK is connected to one head control unit HSU by a board-to-board connector. In addition, the drive substrate DK is connected to one ink jet head HD via a flexible flat cable FFC and a relay substrate CK. That is, one ink jet head HD is connected to one head control unit HSU via the drive substrate DK, the flexible flat cable FFC, and the relay substrate CK. Therefore, since the number of ink jet heads HD that the ink jet head unit 53 has is 32 in the embodiment, the head control substrate HK includes at least the numbers of head control units HSU and the FPGAs 500 so as to correspond to the 32 ink jet heads HD.

Note that the ink jet head HD and the relay substrate CK are connected by a board-to-board connector. Therefore, the user can detach the ink jet head HD from the relay substrate CK and easily achieve the replacement without inserting and pulling-out the flexible flat cable FFC and the like when the user exchanges the ink jet head HD.

Note that the ink jet heads HD illustrated in FIG. 3 are illustrated such that the chips CP are arranged in an aligned manner. However, the actual chips CP are arranged in the zigzag manner as illustrated in FIG. 2.

One head control unit HSU includes a head control unit (HCU) 501 and a head pulse unit (HPU) 502.

The HCU 501 is connected to one ink jet head HD via the drive substrate DK, the flexible flat cable FFC, and the relay substrate CK. The HCU 501 is a module that controls the ejection from the ink jet heads HD and has the configuration as illustrated in FIG. 4.

Figure 4:
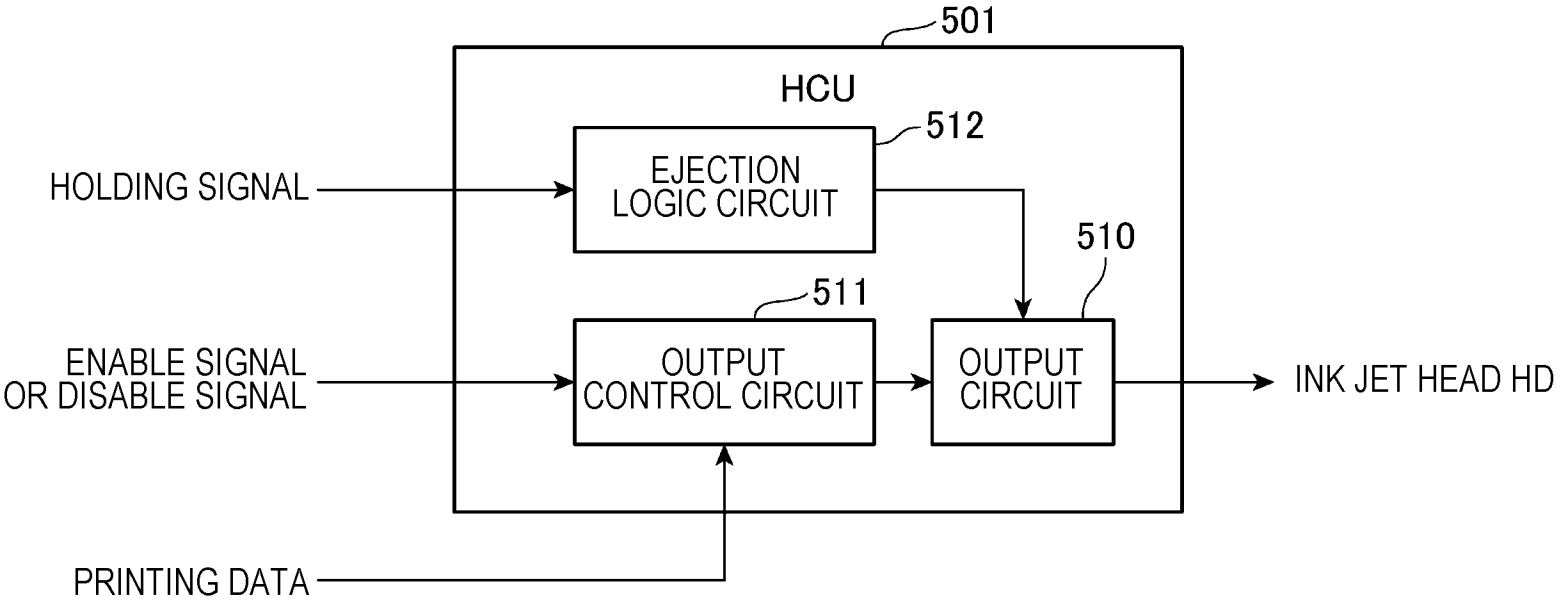
FIG. 4 is a diagram illustrating a configuration of an HCU.

FIG. 4 is a diagram illustrating a configuration of the HCU 501.

As illustrated in FIG. 4, the HCU 501 includes one multiprocessor, for example, and includes an output circuit 510, an output control circuit 511, and an ejection logic circuit 512.

The output circuit 510 transmits data to the corresponding ink jet head HD. In the embodiment, the output circuit 510 transmits any of data indicating "00", data indicating "01", and data indicating "11" that are 2-bit data. The data indicating "00" is data for causing the ink jet head HD to minutely vibrate. The minute vibration indicates that a voltage is applied to the piezoelectric element so as to cause the piezoelectric element to vibrate within a range in which the ink is not ejected from the ejection port. The ink supplied to the ink chamber is stirred by the minute vibration in conjunction with the vibration of the piezoelectric element, and it is possible to suppress an increase in viscosity of the ink. The data indicating "01" is data for causing each nozzle included in the ink jet head HD to execute ejection of the ink dots (hereinafter, expressed as "S dots") with a smaller diameter than that of the data indicating "11". The data indicating "11" is data for causing each nozzle included in the ink jet head HD to execute ejection of the ink dots (hereinafter, expressed as "L dots") with a larger diameter than that of the data indicating "01". The output circuit 510 generally transmits any of the data indicating "00", the data indicating "01", and the data indicating "11" to the one ink jet head HD on the basis of printing data.

The output control circuit 511 is a control circuit that controls transmission of data from the output circuit 510.

In the embodiment, the output control circuit 511 controls data transmission from the output circuit 510 on the basis of an enable signal and a disable signal input from the outside of the HCU 501. That is, the output control circuit 511 causes the output circuit 510 to transmit any of the above data to the corresponding ink jet head HD on the basis of the printing data in a case in which the enable signal is input from the outside. Meanwhile, the output control circuit 511 does not execute data transmission from the output circuit 510 in a case in which the disable signal is input from the outside. That is, the output control circuit 511 does not execute data output from the HCU 501 itself in the case in which the disable signal is input from the outside. If the data output from the HCU 501 itself is not executed, the ink jet head HD corresponding to the HCU 501 does not execute ink ejection. In this manner, the output control circuit 511 can control ON/OFF of the ink ejection from the corresponding ink jet head HD in accordance with the enable signal or the disable signal input from the outside.

In the embodiment, the output control circuit 511 controls data transmission from the output circuit 510 by differentiating the types of data transmitted from the output circuit 510 on the basis of header data included in the printing data. A predetermined bit number of identification information of the ink jet head HD can be stored in the head data included in the printing data. The output control circuit 511 causes the output circuit 510 to transmit only the data indicating "00" to the ink jet head HD in a case in which the identification information of the HCU 501 of itself is included in the header data included in the printing data. The ink jet head HD to which the data indicating "00" has been transmitted merely executes minute vibration and does not execute ink ejection. Meanwhile, the output control circuit 511 causes the output circuit 510 to transmit any of the above data to the corresponding ink jet head HD in a case in which the identification information is not included. In this manner, the output control circuit 511 controls ON/OFF of the ink ejection from the corresponding ink jet head HD on the basis of the header data included in the printing data. During the OFF of the ink ejection under the control, the ink jet head HD executes the minute vibration as compared with the input of the disable signal.

The ejection logic circuit 512 includes a flipflop and the like, for example, and holds data indicating a transmission form of data from the output circuit 510. The output circuit 510 differentiates the data transmission form in accordance with the data held by the ejection logic circuit 512. In the embodiment, in a case in which the ejection logic circuit 512 holds data indicating "0", the output circuit 510 transmits any of the above data to the corresponding ink jet head HD. The output circuit 510 transmits only data indicating "00" to the corresponding ink jet head HD in a case in which the ejection logic circuit 512 holds data indicating "1". As described above, the ink jet head HD, to which the data indicating "00" has been transmitted, merely executes minute vibration and does not execute ink ejection. Note that the ejection logic circuit 512 differentiates the held data between "0" and "1" in accordance with the held signal input from the outside. In this manner, the ejection logic circuit 512 controls ON/OFF of the ink ejection from the corresponding ink jet head HD in accordance with the held data. During the OFF of the ink ejection under the control, the ink jet head HD executes the minute vibration as compared with the input of the disable signal.

In this manner, the HCU 501 according to the embodiment controls ON/OFF of the ink ejection from the corresponding ink jet head HD by the three methods.

Returning to the description of FIG. 3, the HPU 502 is connected to one ink jet head HD via the drive substrate DK, the flexible flat cable FFC, and the relay substrate CK. The HPU 502 transmits a voltage signal (hereinafter, expressed as a "COM signal) that is applied to the piezoelectric element of the connected ink jet head HD via these parts. Although the HPU 502 transmits a digital COM signal to the corresponding ink jet head HD, an analog COM signal is transmitted to the corresponding ink jet head HD as a result of an amplifier AMP of the drive substrate DK converting the digital COM signal into the analog signal.

The COM signal transmitted by the HPU 502 includes two types of signals, namely a COMA signal and a COMB signal. The COMA signal has a waveform of a voltage for ejecting the ink of L dots. Meanwhile, the COMB signal has a waveform of a voltage for causing the piezoelectric element to minutely vibrate and a waveform of a voltage for ejecting the ink of S dots.

The COM signal including the COMA signal and the COMB signal is input from the corresponding HPU 502 to the ink jet head HD. Then, an integrated circuit (IC) 504 of the ink jet head HD selects the waveform to be applied to the piezoelectric element form the COM signal on the basis of the data input from the corresponding HCU 501 and applies the voltage with the selected waveform to the piezoelectric element. In a case in which the data indicating "00" has been input from the HCU 501, for example, the IC 504 of the ink jet head HD selects a waveform of the minute vibration from the COMB signal, applies the voltage with the waveform to the piezoelectric element, and causes the piezoelectric element to minutely vibrate. In a case in which the data indicating "01" has been input from the HCU 501, for example, the IC 504 of the ink jet head HD selects the waveform for ejecting the ink of S dots from the COMB signal, applies the voltage with the waveform to the piezoelectric element, and causes the nozzles to eject the ink of S dots. In a case in which the data indicating "11" has been input from the HCU 501, for example, the IC 504 of the ink jet head HD selects the waveform for ejecting the ink of L dots from the COMA signal, applies the voltage with the waveform to the piezoelectric element, and causes the nozzles to eject the ink with L dots.

As described above, the printer 1 according to the embodiment causes the heating section 7 to heat the medium M when the printer 1 ejects the ink from the ink jet head unit 53 and executes printing. In this manner, the printer 1 can quickly dry and fix the ejected ink on the medium M, prevent blooding, blur, and the like, and improve printing quality.

Incidentally, in a case in which an error has occurred in a certain ink jet head HD, and the ink jet head HD cannot be used, a state like a missing tooth occurs in the ink jet head unit 53. In the embodiment, the state like a missing tooth indicates a state in which a part of ink jet heads HD in the ink jet heads HD aligned in the transport direction H or the intersecting direction Y cannot be used in the ink jet head unit 53. Note that in the embodiment, the state like a missing tooth does not indicate a state in which all the ink jet heads HD aligned in the transport direction H or the intersecting direction Y cannot be used in the ink jet head unit 53. In the case of the ink jet head unit 53 illustrated in FIG. 2, for example, the state like a missing tooth indicates a state in which the ink jet head HD 63 cannot be used and does not indicate the state in which all the ink jet heads HD that the head array HR or the head row HG including the ink jet head HD63 has cannot be used.

If the printer 1 causes the ink jet head unit 53, in which the state like a missing tooth has occurred, to execute printing, the ink is not ejected from the ink jet head HD that cannot be used. Therefore, a degree of drying of the ink ejected from the other ink jet heads HD (in particular, the ink jet heads HD in the vicinity of the ink jet head HD that cannot be used) changes, and this is accompanied by a change in a degree of mixing of the ink.

For example, the carriage 52 moves to either one of sides in the intersecting direction Y, and the ink is ejected from each of the ink jet head HD53, the ink jet head HD63, the ink jet head HD73, and the ink jet head HD83 onto predetermined positions on the medium M at appropriate timings to form dots of one color on the medium M. In an ordinary case (in a case in which the state like a missing tooth has not occurred), the ink is ejected in the order of the ink jet head HD53, the ink jet head HD63, the ink jet head HD73, and the ink jet head HD83 or in the opposite order at specific intervals in conjunction with the movement of the carriage 52 to form dots of one color at predetermined positions on the medium M. Here, in a case in which the ink jet head HD63 cannot be used, the ink is not ejected onto the predetermined positions on the medium M at the specific intervals, and the degree of drying of the ink ejected from the ink jet head HD53, the ink jet head HD73, and the ink jet head HD83 changes. This is accompanied by a change in the degree of mixing of the ink at the predetermined positions on the medium M, and the appropriate color is not formed on the medium M. That is, unevenness in drying occurs on the medium M, and printing quality is degraded.

Here, it is considered that the ink is appropriately ejected from the ink jet head HD53, the ink jet head HD73, and the ink jet head HD83 to complementarily form dots with the same color as the one color. However, the degree of drying of the ink ejected from the other ink jet heads HD changes in a period of time, during which the ink jet head HD 63 does not eject the ink, if the ink jet head HD 63 cannot be used in the printer 1 according to the embodiment. Therefore, there is a high possibility that the printer 1 cannot complementarily form the dots with the one color, and there is a concern that printing quality is degraded if the state like a missing tooth has occurred in the ink jet head unit 53. Further, if it is attempted to dry the ejected ink by heating the medium M, there is a concern that the degree of drying more significantly changes and printing quality is degraded.

In this manner, there is a concern that printing quality is degraded if the state like a missing tooth has occurred in the ink jet head unit 53 in the printer 1.

Thus, the printer control device 10 according to the embodiment executes operations described below. Hereinafter, operations of the printer 1 will be described through description of the error detection section 110, the designation section 120, and the head control section 130 included in the printer control section 100.

Figure 5:
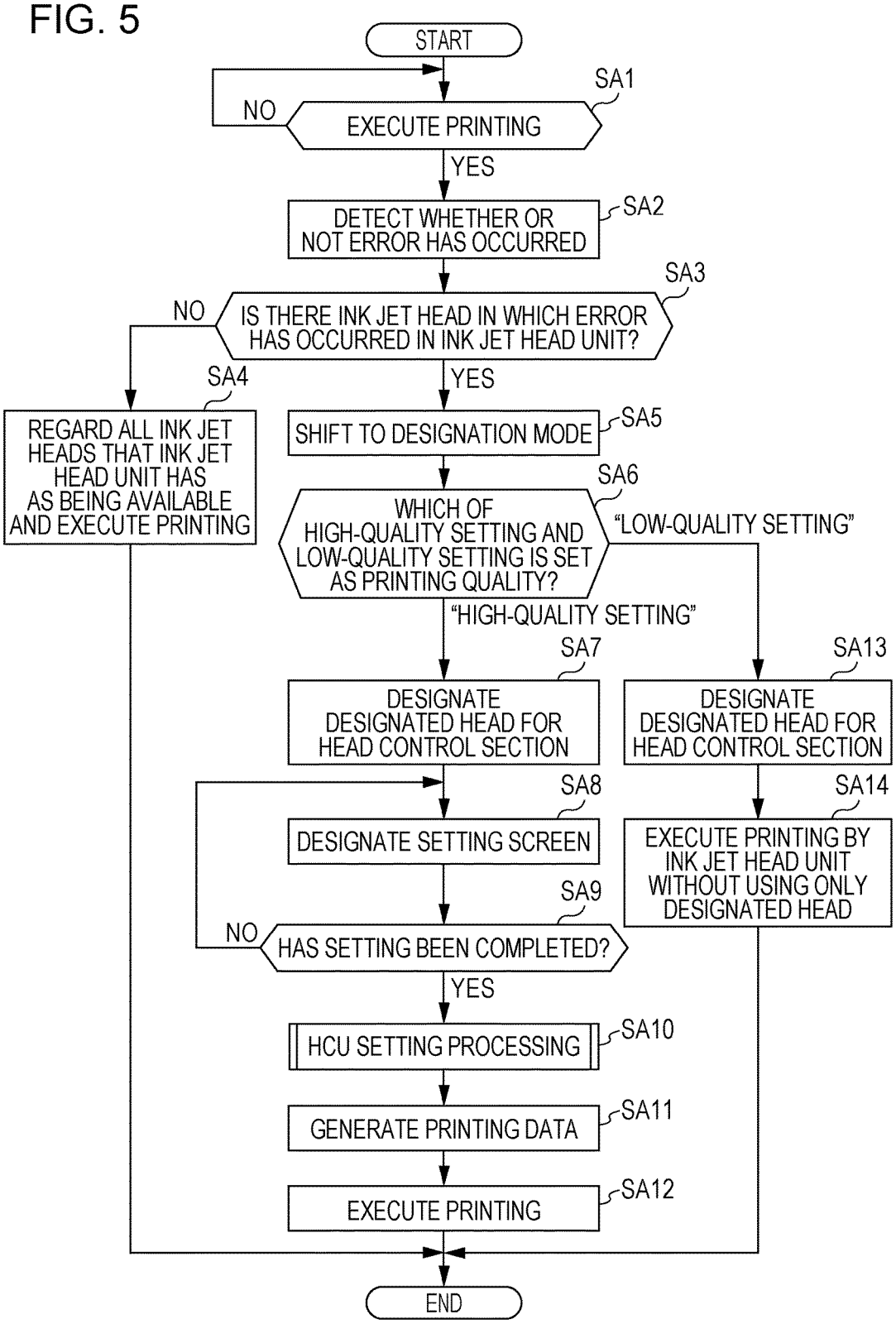
FIG. 5 is a flowchart illustrating operations of a printer control device.

FIG. 5 is a flowchart illustrating operations of the printer control device 10.

It is assumed that an operation mode of the head control section 130 at a start point of the flowchart illustrated in FIG. 5 is an ordinary mode. The ordinary mode in the embodiment is an operation mode in which all the ink jet heads HD included in the ink jet head unit 53 are regarded as the ink jet heads HD that can be used and the ink jet heads HD are caused to be execute printing.

The printer control section 100 of the printer control device 10 determines whether or not to cause the ink jet head unit 53 to execute printing (Step SA1). In a case in which image data is received from the host computer 300 by the communication section 11, for example, the printer control section 100 is triggered by the reception of the image data and determines to execute the printing (Step SA1: YES). Note that in this case, the printer control section 100 generates printing data based on the image data by executing image processing (resolution conversion processing, color conversion processing, halftone processing, rasterization processing, command addition processing, and the like) on the received image data and determines to execute printing based on the generated printing data. In a case in which the input section 12 detects an operation designating execution of printing, for example, the printer control section 100 is triggered by the detection and determines to execute printing (SA1: YES).

Note that the resolution conversion processing is processing of converting image data received from the host computer 300 into printing data with set resolution. The color conversion processing is processing of converting image data in an RGB color space into printing data in a CMYK color space, for example. The halftone processing is processing of converting image data of a large number of grayscales (256 grayscales) into printing data of the number of grayscales that the printer 1 can form. The rasterization processing is processing of rearranging pixel data (for example, 1-bit or 2-bit data) aligned in a matrix shape in a dot formation order at the time of printing. The pixel data aligned in the matrix shape is assigned to actual nozzles that form the respective raster lines that are included in the image to be printed. The command addition processing is processing of adding a command in accordance with printing operations of the printer 1 to the printing data after the rasterization processing. Examples of the command include a command for designating transport of the medium M (the amount, the speed, and the like of the movement in the transport direction H).

Then, if the printer control section 100 determines to execute printing (SA1: YES), the error detection section 110 of the printer control section 100 detects whether or not an error has occurred in the respective ink jet heads HD that the ink jet head unit 53 has (Step SA2). The error indicates missing of a nozzle that is included in the nozzle arrays NR in the embodiment. The missing of the nozzle indicates a state in which the ink is not ejected normally from the nozzle due to ink clogging at the nozzle, drying of the ink remaining in the nozzle, contamination of the nozzle, or another reason.

The error detection section 110 detects whether or not the missing of the nozzle has occurred by the following method, for example. For example, a nozzle missing mechanism for detecting whether or not the nozzle missing has occurred is provided in the printer 1. The nozzle missing mechanism includes an electrode for charging the ink ejected from the nozzle. The nozzle missing mechanism includes a conductive member on which ink ejected from the nozzle lands. An electric signal that flows through the conductive material is output to a predetermined signal processing circuit.

With the aforementioned configuration, the error detection section 110 causes a predetermined amount of ink particle to be ejected from a nozzle that is a target of the detection of whether or not the nozzle missing has occurred. The ejected ink particle is charged with a predetermined amount of electric charge by an electrode and then lands on the conductive material. A state of a current in the conductive material changes in accordance with the landing of the ink particle, and a signal indicating the amount of change is output to the error detection section 110 via a predetermined signal processing circuit. In a case in which a value indicated by the input signal exceeds a predetermined threshold value, the error detection section 110 determines that the assumed amount ink has been ejected normally and the missing of the corresponding nozzle has not occurred. Meanwhile, in a case in which the value indicated by the input signal is less than the predetermined threshold value, the error detection section 110 determines that the assumed amount of ink has not been ejected normally for some reason and the missing of the corresponding nozzle has occurred. The error detection section 110 detects whether or not the nozzle missing has occurred for all the nozzles that one ink jet head HD has by the aforementioned method, and in a case in which the number of missing nozzles is equal to or greater than a predetermined number, the error detection section 110 detects the ink jet head HD as an ink jet head HD in which an error has occurred. Further, the error detection section 110 detects whether or not an error has occurred for all the ink jet heads HD that the ink jet head unit 53 has by the aforementioned method.

Note that the method of detecting whether or not nozzle missing has occurred is not limited to the aforementioned method. For example, whether or not missing of a corresponding nozzle has occurred may be determined by ejecting the ink from the target nozzle onto the medium M to form a dot and optically reading the formed dot.

Alternatively, whether or not nozzle missing has occurred may be determined by monitoring a signal waveform of a control signal or the like that drives an actuator. That is, any method may be used to execute the error detection as long as it is possible to detect whether or not nozzle missing has occurred for the respective nozzles.

Then, the error detection section 110 determines whether or not there is an ink jet head HD, in which an error has occurred, in the ink jet head unit 53 by executing the processing in Step SA2 (Step SA3). In a case in which the error detection section 110 determines that there is no ink jet head HD, in which an error has occurred, in the ink jet head unit 53 (Step SA3: NO), the head control section 130 regards all the ink jet heads HD that the ink jet head unit 53 has as ink jet heads HD that can be used and causes the ink jet heads HD to execute printing (Step SA4).

Meanwhile, in a case in which the error detection section 110 has determined that there is an ink jet head HD, in which an error has occurred, in the ink jet head unit 53 (Step SA3: YES), the printer control section 100 shifts the operation mode to the designation mode (Step SA5). The designation mode is an operation mode in which the ink jet head HD, in which the error has occurred, is designated as an ink jet head HD, the use of which is inhibited at the time of execution of printing, and is an operation mode in which the printing is executed without using at least the ink jet head HD, in which the error has occurred, as will become obvious from the following description.

Then, the printer control section 100 determines which of high-quality setting (first setting) and low-quality setting (second setting) set printing quality is (Step SA6). The high-quality setting is setting in which priority is placed on an increase in printing quality, and is setting in which the printing is executed by setting the size of dots formed on the medium M to S dots and the printing is executed by setting resolution to be higher than that in the low-quality setting. The low-quality setting is setting in which priority is placed on an increase in the printing speed and is setting in which the printing is executed by setting the size of dots formed on the medium M to L dots and the printing is executed by setting the resolution to be lower and setting the printing speed to be higher as compared with those in the high-quality setting, for example. In a case in which a setting value indicating the high-quality setting is set in a setting item regarding printing quality in a setting file, for example, the printer control section 100 determines that the high-quality setting is set as the printing quality (Step SA6: "high-quality setting"). In a case in which a setting value indicating the low-quality setting is set, the printer control section 100 determines that the low-quality setting is set as the printing quality (Step SA6: "low-quality setting").

In the case in which the printer control section 100 determines that the high-quality setting is set as the printing quality (Step SA6: "high-quality setting"), the designation section 120 designates the ink jet head HD, which is detected by the error detection section 110, in which the error has occurred, as the ink jet head HD, the use of which is inhibited at the time of execution of printing for the head control section 130 (Step SA7).

Then, the head control section 130 causes a display section 14 to display a setting screen for setting the ink jet heads HD that are not used at the time of execution of printing on the basis of the ink jet head HD (hereinafter, expressed as a "designated head HD") (designated head) designated by the designation section 120 in Step SA7 (Step SA8).

Figure 6:
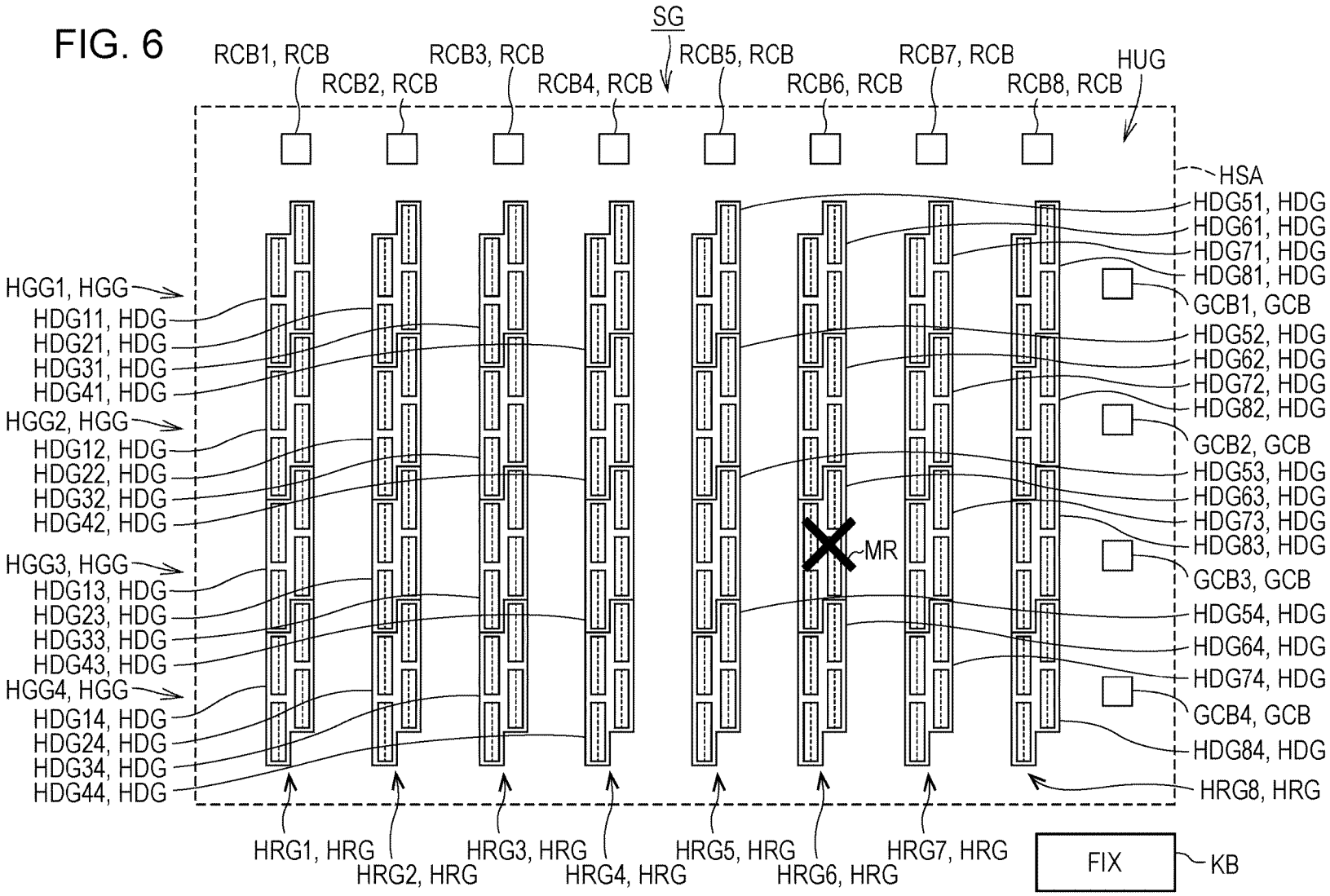
FIG. 6 is a diagram illustrating an example of a setting screen.

FIG. 6 is a diagram illustrating an example of a setting screen SG.

As illustrated in FIG. 6, the setting screen SG has a head setting region HSA for setting the ink jet heads HD that are not used at the time of execution of printing and a fixation button KB for fixing the ink jet head HD set in the head setting region HSA.

As illustrated in FIG. 6, the head setting region HSA displays a head unit image HUG indicating the ink jet head unit 53. The head unit image HUG has the same number of head images HDG indicating the ink jet heads HD as the number of the ink jet heads HD included in the ink jet head unit 53 in the same alignment.

A head image HDG11 is a head image HDG indicating the ink jet head HD11. Similarly, the respective head images HDG12 to HDG84 are head images HDG indicating the corresponding ink jet heads HD12 to HD84.

Since the head images HDG11 to HDG84 are displayed in this manner, the head unit image HUG has head array images HRG corresponding to the number of the head arrays HR that the ink jet head unit 53 has. A head array image HRG1 is a head array image HRG indicating the head array HR1 of the ink jet head unit 53. A head array image HRG2 is a head array image HRG indicating the head array HR2 of the ink jet head unit 53. A head array image HRG3 is a head array image HRG indicating the head array HR3 of the ink jet head unit 53. A head array image HRG4 is a head array image HRG indicating the head array HR4 of the ink jet head unit 53. A head array image HRG5 is a head array image HRG indicating the head array HR5 of the ink jet head unit 53. A head array image HRG6 is a head array image HRG indicating the head array HR6 of the ink jet head unit 53. A head array image HRG7 is a head array image HRG indicating the head array HR7 of the ink jet head unit 53. A head array image HRG8 is a head array image HRG indicating the head array HR8 of the ink jet head unit 53.

Since the head images HDG11 to HDG84 are displayed, the head unit image HUG has head row images HGG corresponding to the number of head rows HG that the ink jet head unit 53 has. A head row image HGG1 is a head row image HGG indicating the head row HG1 of the ink jet head unit 53. A head row image HGG2 is a head row image HGG indicating the head row HG2 of the ink jet head unit 53. A head row image HGG3 is a head row image HGG indicating the head row HG3 of the ink jet head unit 53. A head row image HGG4 is a head row image HGG indicating the head row HG4 of the ink jet head unit 53.

As illustrated in FIG. 6, array check boxes RCB for selecting the ink jet heads HD that are not used at the time of execution of printing in units of the head arrays HR are displayed in the head setting region HSA so as to correspond to the number of the head array images HRG.

An array check box RCB1 is an array check box RCB for selecting all the ink jet heads HD included in the head array HR1 as ink jet heads HD that are not used at the time of execution of printing.

An array check box RCB2 is an array check box RCB for selecting all the ink jet heads HD included in the head array HR2 as ink jet heads HD that are not used at the time of execution of printing.

An array check box RCB3 is an array check box RCB for selecting all the ink jet heads HD included in the head array HR3 as ink jet heads HD that are not used at the time of execution of printing.

An array check box RCB4 is an array check box RCB for selecting all the ink jet heads HD included in the head array HR4 as ink jet heads HD that are not used at the time of execution of printing.

An array check box RCB5 is an array check box RCB for selecting all the ink jet heads HD included in the head array HR5 as ink jet heads HD that are not used at the time of execution of printing.

An array check box RCB6 is an array check box RCB for selecting all the ink jet heads HD included in the head array HR6 as ink jet heads HD that are not used at the time of execution of printing.

An array check box RCB7 is an array check box RCB for selecting all the ink jet heads HD included in the head array HR7 as ink jet heads HD that are not used at the time of execution of printing.

An array check box RCB8 is an array check box RCB for selecting all the ink jet heads HD included in the head array HR8 as ink jet heads HD that are not used at the time of execution of printing.

As illustrated in FIG. 6, row check boxes GCB for selecting ink jet heads HD that are not used at the time of execution of printing in units of head rows HG are displayed so as to correspond to the number of head row images HGG in the head setting region HSA.

A row check box GCB1 is a row check box GCB for selecting all the ink jet heads HD included in the head row HG1 as ink jet heads HD that are not used at the time of execution of printing.

A row check box GCB2 is a row check box GCB for selecting all the ink jet heads HD included in the head row HG2 as ink jet heads HD that are not used at the time of execution of printing.

A row check box GCB3 is a row check box GCB for selecting all the ink jet heads HD included in the head row HG3 as ink jet heads HD that are not used at the time of execution of printing.

A row check box GCB4 is a row check box GCB for selecting all the ink jet heads HD included in the head row HG4 as ink jet heads HD that are not used at the time of execution of printing.

As illustrated in FIG. 6, a mark MR indicating inhibition of use is added so as to be overlaid on the head image HDG indicating the designated head HD in the head setting region HSA. Since the ink jet head HD 63 is exemplified as the designated head HD in FIG. 6, the mark MR is added so as to be overlaid on the head image HDG63 in the head setting region HSA. Since the mark MR indicating inhibition of use is added in this manner, the user can easily recognize which of the ink jet heads HD included in the ink jet head unit 53 is the ink jet head HD (the ink jet head HD, use of which is inhibited), in which the error has occurred when the user sets the ink jet heads HD that are not used at the time of execution of printing.

The fixation button KB is a button that can be selected by the user and fixes the ink jet heads HD set in the head setting region HSA as the ink jet heads HD that are not used at the time of execution of printing. The fixation button KB cannot be selected by the user until the head array image HRG or the head row image HGG including the head image HDG, to which the mark MR is added, is selected in the head setting region HSA. Since the mark MR is added to the head image HDG 63 in the case illustrated in FIG. 6, the fixation button KB cannot be selected by the user until the head array image HRG6 or the head row image HGG3 is selected in the head setting region HSA. In this manner, the setting screen SG can prevent the printing from being executed in the state like a missing tooth in the ink jet head unit 53.

In a case in which the head array image HRG including the head image HDG with the mark MR added thereto is selected in the array check box RCB, or in a case in which the head row image HGG including the head image HDG with the mark MR added thereto is selected in the row check box GCB in the head setting region HSA, the head control section 130 sets the ink jet heads HD that are not used at the time of execution of printing in the head setting region HSA as described below.

In Case in which Head Row Image HGG is Selected

First, the case in which the head row image HGG including the head image HDG with the mark MR added thereto is selected will be described. In the case in which the head row image HGG including the head image HDG with the mark MR added thereto is selected, the head control section 130 sets the ink jet heads HD that are not used at the time of execution of printing in two patterns.

First Pattern

Figure 7A:
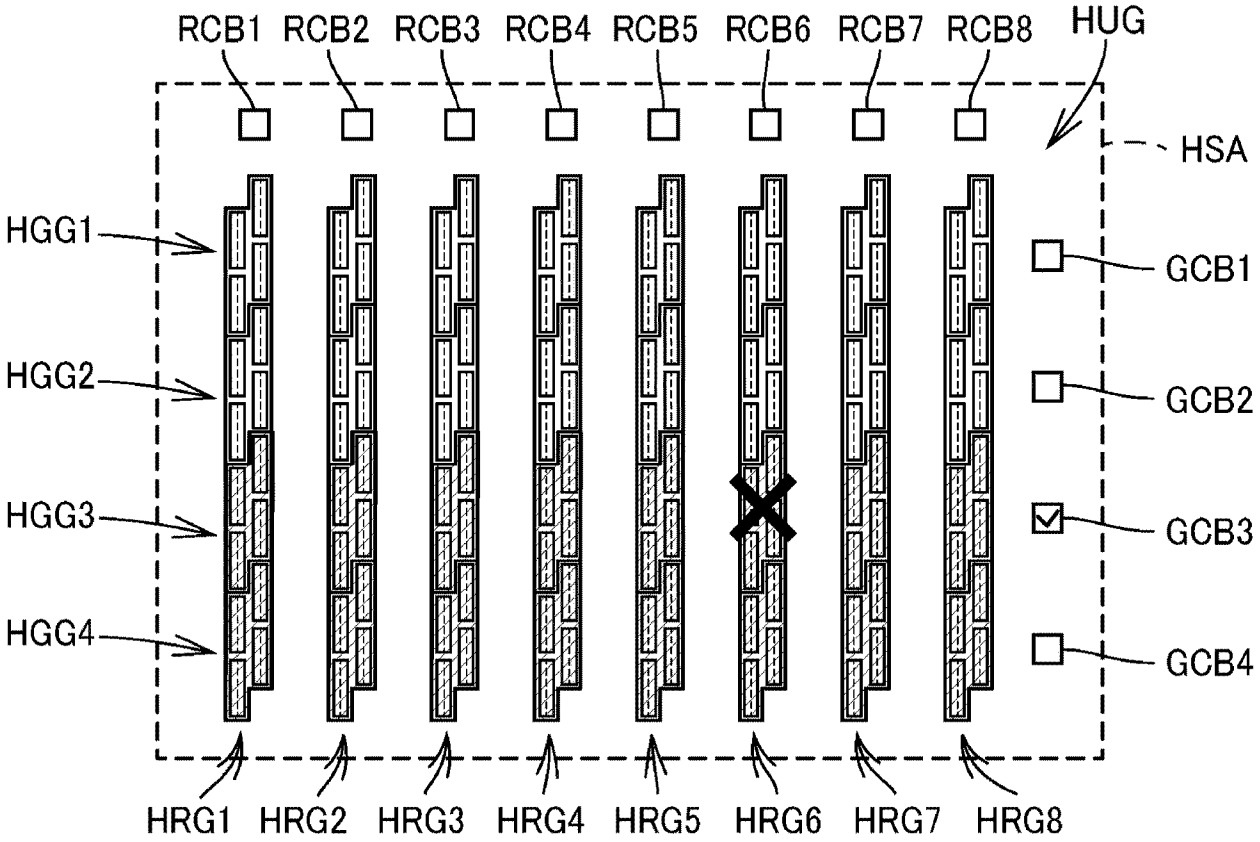
FIG. 7A is a diagram illustrating an example of a head setting region.

FIG. 7A is a diagram illustrating an example of the head setting region HSA in the first pattern.

The head unit image HUG indicated in the head setting region HSA in FIG. 7A is the same as the head unit image HUG indicated in the head setting region HSA in FIG. 6. The head image HDG with the mark MR added thereto as illustrated in FIG. 7A is the same as the head image HDG with the mark MR added thereto as illustrated in FIG. 6.

The row check box GCB3 is checked in the head setting region HSA in FIG. 7A. That is, FIG. 7A illustrates that the user has selected the row check box GCB3.

If the row check box GCB3 is selected, the head control section 130 masks all the head images HDG included in the head row image HGG3 with hatching as illustrated in FIG. 7A. Further, if the row check box GCB3 is selected, the head control section 130 masks all the head images HDG aligned on the side of the direction, in which the number of ink jet heads HD aligned in the extending direction of the nozzle array NR from the designated head HD is the smallest, with hatching. At this time, although the head images HDG of the ink jet heads HD corresponding to the row check box GCB4 is masked with hatching to clearly indicate that the ink jet heads HD are not used, the row check box GCB4 may not be checked intentionally in order to clearly indicate that setting of not using the ink jet heads HD is automatically achieved. In a case in which it is assumed that the user performs an operation by using the row check box GCB, the row check box GCB4 may be selected and checked together when the row check box GCB3 is selected and checked.

As illustrated in FIG. 7A, the side of the direction in which the number of ink jet heads HD aligned in the extension direction of the nozzle array NR from the designated head HD (ink jet head HD63) is the smallest is the side on which the head row HG4 is located (the upstream side of the ink jet head unit 53 in the transport direction H). Therefore, the head control section 130 masks all the head images HDG included in the head row image HGG3 and all the head images HDG included in the head row image HGG4 with hatching to differentiate the display form thereof from that of the other head images HDG as illustrated in FIG. 7A. The head control section 130 sets all the ink jet heads HD included in the head row HG3 and all the ink jet heads HD included in the head row HG4 as the ink jet heads HD that are not used at the time of execution of printing in the head setting region HSA. Note that the masking with the hatching in the setting screen SG indicates the head images HDG indicating the ink jet heads HD that are not used at the time of execution of printing.

In this manner, in the case in which the head row image HGG including the head image HDG with the mark MR added thereto is selected, the head control section 130 sets all the ink jet heads HD included in the head row HG corresponding to the head row image HGG as the ink jet heads HD that are not used at the time of execution of printing in the head setting region HSA in the first pattern. In addition, the head control section 130 sets all the ink jet heads HD aligned on the side of the direction, in which the number of ink jet heads HD aligned in the extension direction of the nozzle array NR from the designated head HD is the smallest, as the ink jet heads HD that are not used at the time of execution of printing in the head setting region HSA.

Second Pattern

Figure 7B:
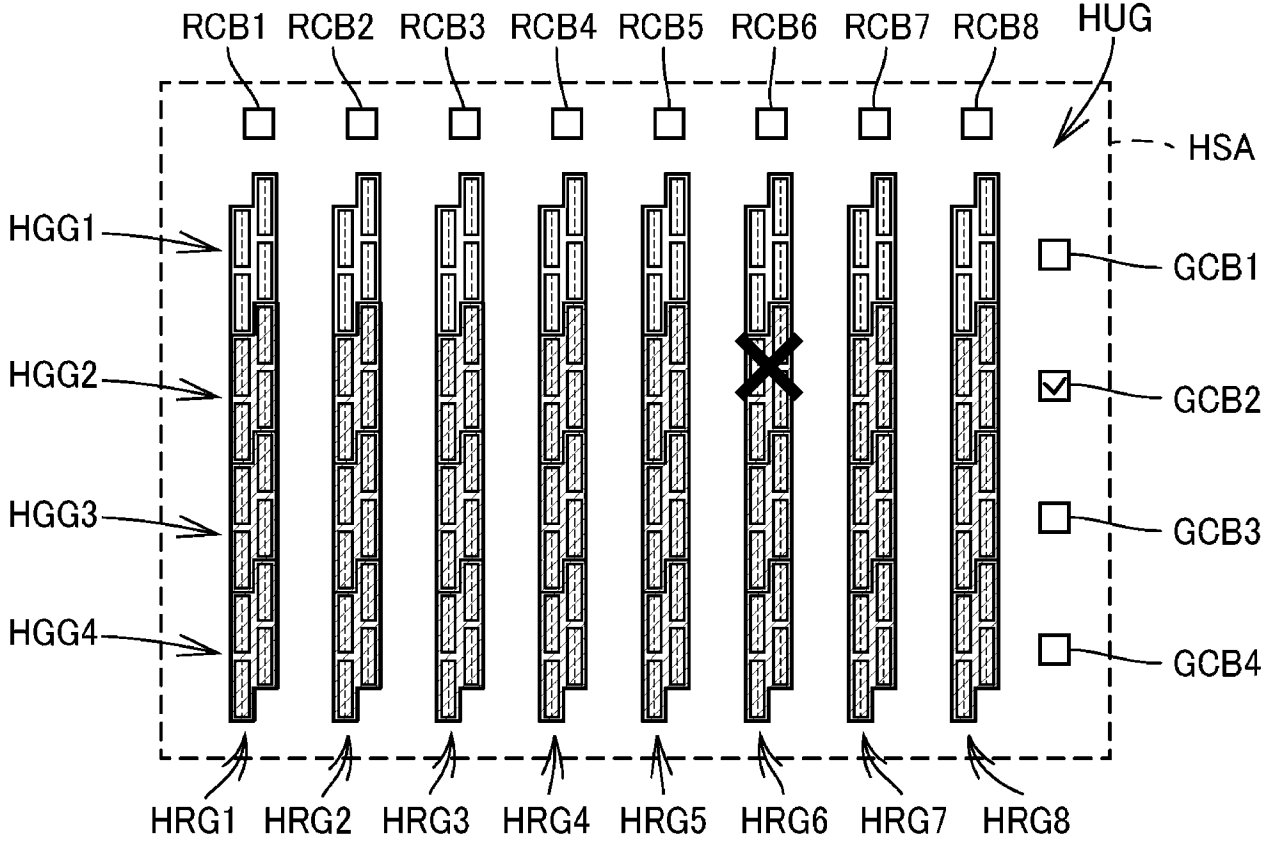
FIG. 7B is a diagram illustrating an example of the head setting region.

FIG. 7B is a diagram illustrating an example of the head setting region HSA in the second pattern.

The head unit image HUG indicated in the head setting region HSA in FIG. 7B is the same as the head unit image HUG indicated in the head setting region HSA in FIG. 6. The head image HDG with the mark MR added thereto as illustrated in FIG. 7B is different from the head image HDG with the mark MR added thereto as illustrated in FIG. 6 and is a head image HDG 62 indicating the ink jet head HD62.

The row check box GCB2 is checked in the head setting region HSA in FIG. 7B. That is, FIG. 7B illustrates that the user has selected the row check box GCB2.

If the row check box GCB2 is selected, the head control section 130 masks all the head images HDG included in the head row image HGG2 and all the head images HDG aligned on the upstream side of the designated head HD in the transport direction H with hatching as illustrated in FIG. 7B. As illustrated in FIG. 2, the ink jet heads HD aligned on the upstream side of the designated head HD (ink jet head HD62) in the transport direction H are all the ink jet heads HD included in the head row HG3 and the head row HG4. Therefore, the head control section 130 masks all the head images HDG included in the head row image HGG2, the head row image HGG3, and the head row image HGG4 with hatching and differentiates the display form from that of the other head images HDG (all the head images HDG included in the head row HG1) as illustrated in FIG. 7B. Then, the head control section 130 sets all the ink jet heads HD included in the head row HG2, the head row HG3, and the head row HG4 as the ink jet heads HD that are not used at the time of execution of printing in the head setting region HSA. Then, the head control section 130 sets all the ink jet heads HD included in the head row HG2, the head row HG3, and the head row HG4 as the ink jet heads HD that are not used at the time of execution of printing in the head setting region HSA. As described above, the masking with the hatching in the setting screen SG indicates the head images HDG indicating the ink jet heads HD that are not used at the time of execution of printing.

In this manner, in the case in which all the head row images HGG including the head image HDG with the mark MR added thereto are selected, the head control section 130 sets all the ink jet heads HD included in the head row HG corresponding to the head row image HGG as the ink jet heads HD that are not used at the time of execution of printing in the head setting region HSA in the second pattern. In addition, the head control section 130 sets all the ink jet heads HD aligned on the upstream side of the designated head HD in the transport direction H as the ink jet heads HD that are not used at the time of execution of printing in the head setting region HSA.

As described above, in the case in which the head row image HGG including the head image HD with the mark MR added thereto is selected, the head control section 130 sets the ink jet head HD corresponding to the head image HD and all the ink jet heads HD aligned on one side in the extension direction of the nozzle array NR with reference to the head image as the ink jet heads HD that are not used at the time of execution of printing in the head setting region HSA.

Figure 7C:
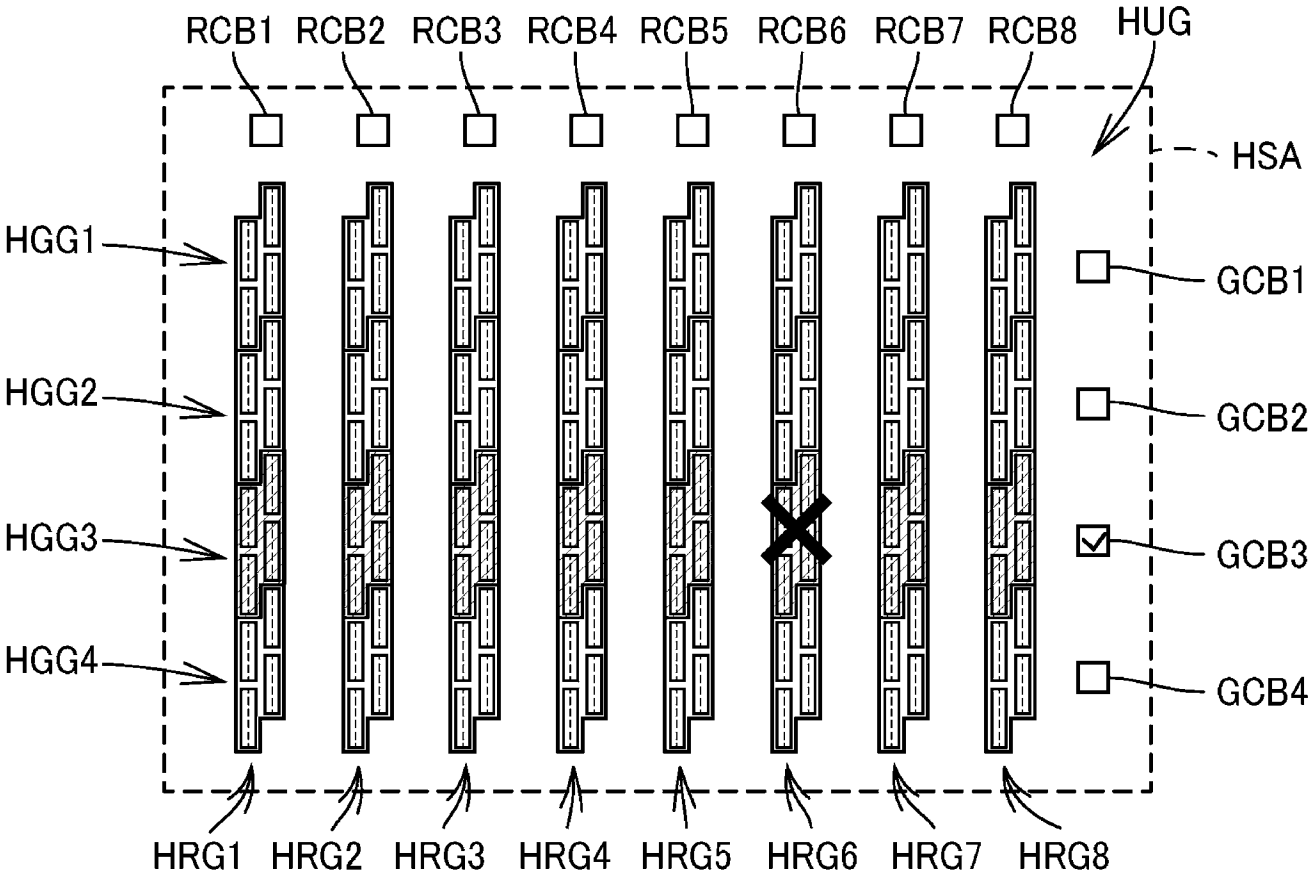
FIG. 7C is a diagram illustrating an example of the head setting region.

Note that the head control section 130 is not limited to the aforementioned patterns, and in the case in which the head row HGG including the head image HD with the mark MR added thereto is selected, the head control section 130 may set the ink jet heads HD that are not used at the time of execution of printing as illustrated in FIG. 7C.

FIG. 7C is a diagram illustrating an example of the head setting region HSA.

The head unit image HUG indicated in the head setting region HSA in FIG. 7C is the same as the head unit image HUG indicated in the head setting region HSA in FIG. 6. The head image HDG with the mark MR added thereto as illustrated in FIG. 7C is the same as the head image HDG with the mark MR added thereto as illustrated in FIG. 6.

The row check box GCB3 is checked in the head setting region HSA in FIG. 7C. That is, FIG. 7C illustrates that the user has selected the row check box GCB3.

If the row check box GCB3 is selected, the head control section 130 masks all the head images HDG included in the head row image HGG3 with hatching and differentiates the display form from that of the other head images HDG as illustrated in FIG. 7C. Then, the head control section 130 sets all the ink jet heads HD included in the head row HG3 as the ink jet heads HD that are not used at the time of execution of printing in the head setting region HSA. Note that the masking with hatching in the setting screen SG indicates the head images HDG of the ink jet heads HD that are not used at the time of execution of printing.

In this manner, in the case in which the head row image HGG including the head image HDG with the mark MR added thereto is selected, the head control section 130 sets all the ink jet heads HD included in the head row HG corresponding to the head row image HGG as the ink jet heads that are not used at the time of execution of printing in the head setting region HSA.

In Case in which Head Array Image HRG is Selected

Next, a case in which the head array image HRG including the head image HDG with the mark MR added thereto is selected will be described.

Figure 8:
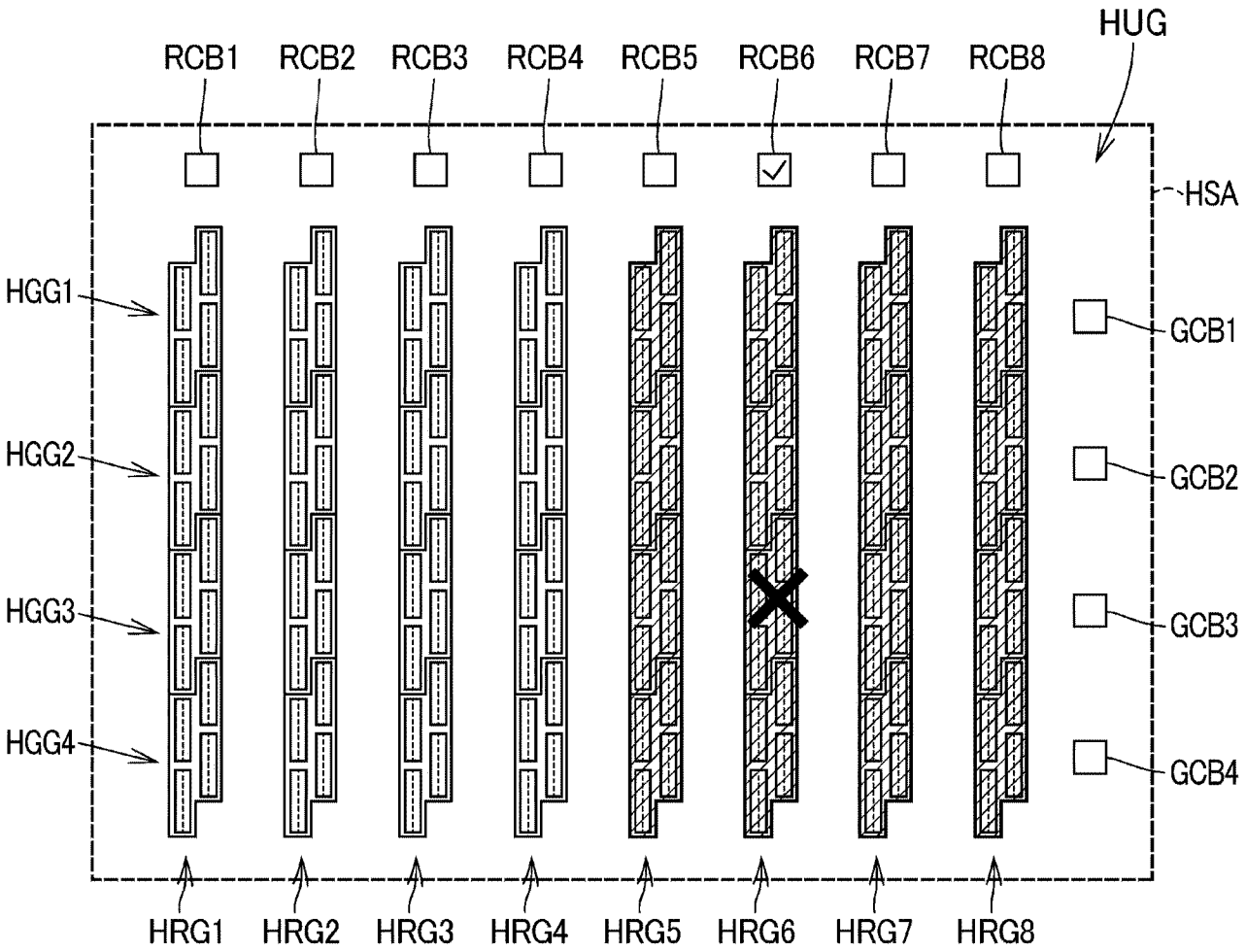
FIG. 8 is a diagram illustrating an example of the head setting region.

FIG. 8 is a diagram illustrating an example of the head setting region HSA in a case in which the head array image HRG is selected.

The head unit image HUG indicated in the head setting region HSA in FIG. 8 is the same as the head unit image HUG indicated in the head setting region HSA in FIG. 6. The head image HDG with the mark MR added thereto as illustrated in FIG. 8 is the same as the head image HDG with the mark MR added thereto as illustrated in FIG. 6.

The array check box RCB6 is checked in the head setting region HSA in FIG. 8. That is, FIG. 8 illustrates that the user has selected the array check box RCB6.

If the array check box RCB6 is selected, the head control section 130 masks all the head images HDG included in the head array images HRG5 to HRG8 with hatching and differentiates the display form from that of the other head images HDG (all the head images HDG included in the head array images HRG1 to HRG4) as illustrated in FIG. 8. Then, the head control section 130 sets all the ink jet heads HD included in the head arrays HR5 to HR8 as the ink jet heads HD that are not used at the time of execution of printing in the head setting region HSA.

As described above, the ink jet head unit 53 has head arrays HR1 to HR8 for different colors so as to be linearly symmetric with respect to the substantially central portion TB in the intersecting direction Y. That is, the head control section 130 sets the ink jet heads HD that are not used at the time of execution of printing such that at least one head array HR remains for each color of the ink ejected by the ink jet head unit 53 by employing the setting as illustrated in FIG. 8.

In the case in which the head array image HRG is selected in this manner, the head control section 130 sets all the ink jet heads HD included in the head array HR corresponding to the head array image HRG as the ink jet heads that are not used at the time of execution of printing in the head setting region HSA. In addition, the head control section 130 sets the ink jet heads HD that are not used at the time of execution of printing such that at least one head array HR remains for each color of the ink ejected by the ink jet head unit 53.

Here, it is considered to set only the head array HR6 not to be used at the time of execution of printing in the case of FIG. 8 on the basis of a viewpoint that "at least one head array HR is made to remain for each color of the ink ejected by the ink jet head unit 53". However, there is a concern that the ink jet head unit 53 cannot appropriately form colors at the time of printing using the head arrays HR5 to HR8 if the ink jet head unit 53 cannot use only the head array HR6 with the configuration in which the printing is executed by switching the head arrays HR1 to HR4 or the head arrays HR5 to HR8 in accordance with the direction of movement of the carriage 52. Thus, the printer 1 can prevent occurrence of a color that is not formed by the ink jet head unit 53 by intentionally setting the head arrays HR5 to HR8 not to be used and causing the head arrays HR1 to HR4 to address all printing jobs regardless of the direction of movement of the carriage 52 as illustrated in FIG. 8.

Note that FIGS. 7A to 7C and 8 illustrate exemplary cases in which the head images HDG indicating the ink jet heads HD that are not used at the time of execution of printing are masked with hatching and the display form thereof is differentiated from the display form of the head images HDG indicating the ink jet heads HD that are used. However, the display form is not limited to the masking with hatching, and the display form may be differentiated by employing gray-out, addition of a predetermined image, or the like.

Returning to the description of the flowchart illustrated in FIG. 5, the head control section 130 causes the display section 13 to display the setting screen SG and then determines whether or not the setting of the ink jet heads HD that are not used at the time of execution of printing has been completed (Step SA9). In a case in which the fixation button KB displayed in the setting screen SG is selected by the user, the head control section 130 determines that the setting of the ink jet heads HD that are not used at the time of execution of printing has been completed (Step SA9: YES).

In the case in which it is determined that the setting of the ink jet heads HD that are not used at the time of execution of printing has been completed (Step SA9: YES), the head control section 130 executes HCU setting processing on the basis of the setting of the head setting region HSA at the time when the fixation button KB is operated (Step SA10).

Figure 9:
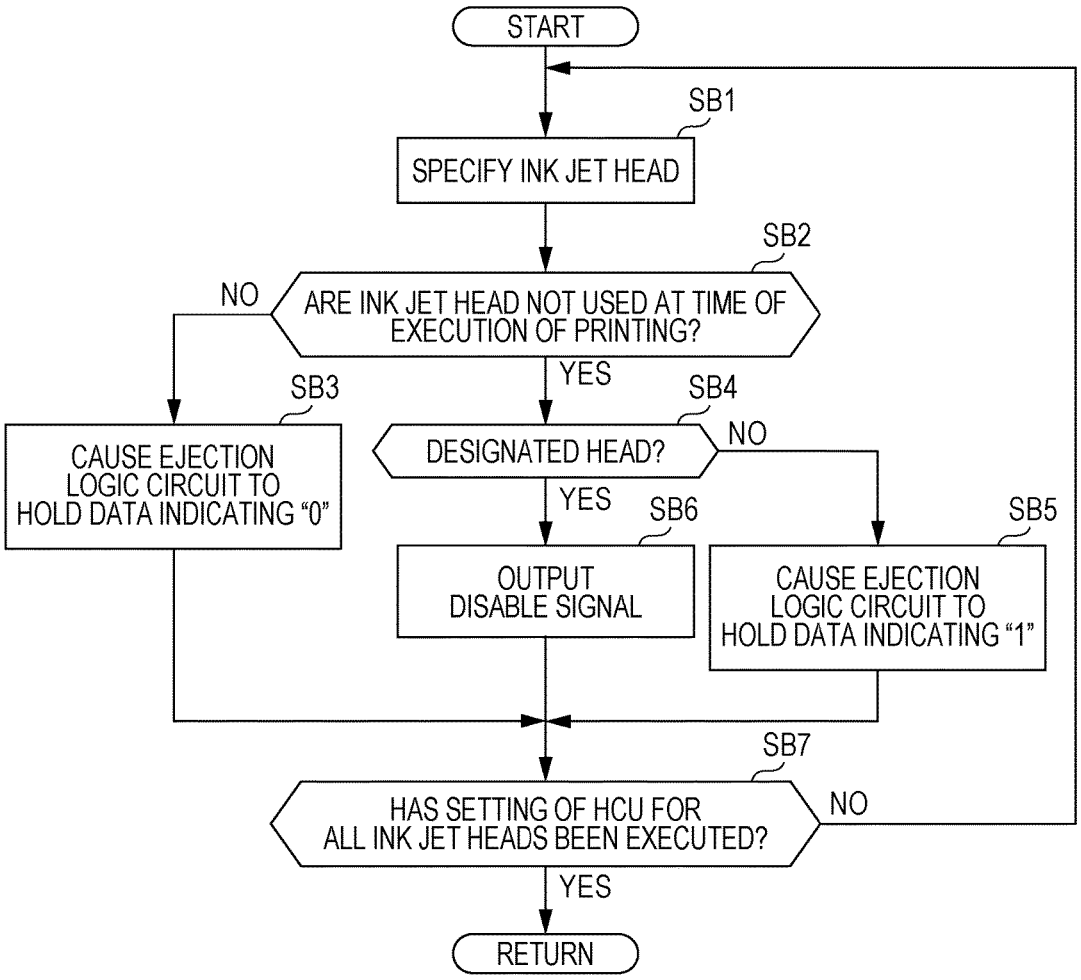
FIG. 9 is a flowchart illustrating operations of the printer control device.

FIG. 9 is a flowchart illustrating operations of the printer control device 10 in the HCU setting processing.

The head control section 130 specifies an ink jet head HD, on which setting of the HCU 501 is to be executed, from among the plurality of ink jet heads HD that the ink jet head unit 53 has (Step SB1). Note that the setting of the HCU 501 indicates execution of processing in any of Steps SB3, SB5, and SB6.

Then, the head control section 130 determines whether or not the ink jet head HD specified in Step SB1 is an ink jet head HD that is not used at the time of execution of printing on the basis of the setting in the head setting region HSA (Step SB2).

In a case in which it is determined that the ink jet head HD specified in Step SB1 is not the ink jet head HD that is not used at the time of execution of printing (Step SB2: NO), the head control section 130 causes the ejection logic circuit 512 of the HCU 501 corresponding to the ink jet head HD specified in Step SB1 to hold data indicating "0" (Step SB3). The head control section 130 outputs a holding signal that designates causing of the ejection logic circuit 512 to hold the data indicating "0" to the HCU 501 and causes the ejection logic circuit 512 to hold the data indicating "0".

Note that the processing in Step SB3 may be processing of the head control section 130 outputting an enable signal to the HCU 501 corresponding to the ink jet head HD specified in Step SB1. In this manner, the ink jet heads HD that are used at the time of execution of printing eject the ink on the basis of the printing data.

Meanwhile, in a case in which it is determined that the ink jet head HD specified in Step SB1 is the ink jet head HD that is not used at the time of execution of printing (Step SB2: YES), the head control section 130 determines whether or not the ink jet head HD is the designated head HD (Step SB4).

In a case in which it is determined that the ink jet head HD specified in Step SB1 is not the designated head HD (Step SB4: NO), the head control section 130 causes the ejection logic circuit 512 of the HCU 501 corresponding to the ink jet head HD to hold data indicating "1" (Step SB5). The head control section 130 outputs a holding signal that designates causing of the ejection logic circuit 512 to hold the data indicating "1" to the HCU 501 and causes the ejection logic circuit 512 to hold the data indicating "1". In this manner, the ink jet head HD that is not the designated head HD and is not used at the time of execution of printing executes minute vibration and does hot execute ink ejection at the time of execution of printing.

Meanwhile, in a case in which it is determined that the ink jet head HD specified in Step SB1 is the designated head HD (Step SB4: YES), the head control section 130 outputs a disable signal to the HCU 501 corresponding to the ink jet head HD (Step SB6). In this manner, since the HCU 501 corresponding to the designated head HD does not execute the data transmission itself at the time of execution of printing, the designated head HD does not execute minute vibration and ink ejection.

Then, the head control section 130 determines whether or not the setting of the HCU 501 has been executed on all the ink jet heads HD that the ink jet head unit 53 has (Step SB7). In a case in which it is determined that the setting of the HCU 501 has been executed on all the ink jet heads HD (Step SB7: NO), the head control section 130 returns the processing to Step SB1 and executes the HCU setting processing on ink jet heads HD, for which the HCU 501 has not been set. Meanwhile, in a case in which it is determined that the setting of the HCU 501 has been executed on all the ink jet heads HD (Step SB7: YES), the head control section 130 completes the HCU setting processing.

In this manner, the head control section 130 sets the corresponding HCU 501 for the respective ink jet heads HD that the ink jet head unit 53 has on the basis of the setting in the head setting region HSA on the setting screen SG in the HCU setting processing.

It is assumed that the setting in the head setting region HSA is the setting illustrated in FIG. 7A, for example. In this case, the head control section 130 sets the respective ink jet heads HD included in the head row HG1 and the head row HG2 to eject the ink based on the printing data. In this case, the head control section 130 sets the ink jet heads HD other than the ink jet head HD63, which is the designated head HD, from among the ink jet heads HD included in the head row HG3 and the head row HG4 to execute minute vibration at the time of execution of printing. In this case, the head control section 130 sets the ink jet head HD63, which is the designated head HD, from among the ink jet heads HD included in the head row HG3 not to execute minute vibration and ink ejection.

It is assumed that the setting in the head setting region HSA is the setting illustrated in FIG. 7B, for example. In this case, the head control section 130 sets the respective ink jet heads HD included in the head row HG1 to eject the ink based on the printing data. In this case, the head control section 130 sets ink jet heads HD other than the ink jet head HD62, which is the designated head HD, from among the ink jet heads HD included in the head row HG2, the head row HG3, and the head row HG4 to execute minute vibration at the time of execution of printing. In this case, the head control section 130 sets the ink jet head HD62, which is the designated head HD, from among the ink jet heads HD included in the head row HG2 not to execute minute vibration and ink ejection.

It is assumed that the setting in the head setting region HSA is the setting illustrated in FIG. 7C, for example. In this case, the head control section 130 sets the respective ink jet heads HD included in the head row HG1, the head row HG2, and the head row HG4 to eject the ink based on the printing data. In this case, the head control section 130 sets the ink jet heads HD other than the ink jet head HD63, which is the designated head HD, from among the ink jet heads HD included in the head row HG3 to execute minute vibration at the time of execution of printing. In this case, the head control section 130 sets the ink jet head HD63, which is the designated head HD, from among the ink jet heads HD included in the head row HG3 not to execute minute vibration and ink ejection.

It is assumed that the setting in the head setting region HSA is the setting illustrated in FIG. 8, for example. In this case, the head control section 130 sets the respective ink jet heads HD included in the head arrays HR1 to HR4 to eject the ink based on the printing data. In this case, the head control section 130 sets the ink jet heads HD other than the ink jet head HD63, which is the designated head HD, from among the ink jet heads HD included in the head arrays HR5 to HR8 to execute minute vibration at the time of execution of printing. In this case, the head control section 130 sets the ink jet head HD63, which is the designated head HD, from among the ink jet heads HD included in the head array HR6 not to execute minute vibration and ink ejection.

Note that the HCU setting processing may be processing of outputting disable signals to the corresponding HCUs 501 for all the ink jet heads HD that are not used at the time of execution of printing including the designated head HD. In this manner, the ink jet heads HD that are not used at the time of execution of printing do not execute minute vibration and ink ejection. The HCU setting processing may be processing of causing the ejection logic circuits 512 of the corresponding HCUs 501 to hold information of "1" for all the ink jet heads that are not used at the time of execution of printing including the designated head HD. This processing causes the ink jet heads HD that are not used at the time of execution of printing including the designated head HD to execute minute vibration while not executing ink ejection.

However, the HCU setting processing is preferably processing of employing such setting that the designated head HD does not execute minute vibration and ink ejection and employing such setting that the ink jet heads HD that are not used at the time of execution of printing other than the designated head HD execute only minute vibration on the basis of the following viewpoint. In general, it is necessary to exchange the ink jet head HD (that is, the designated head HD), in which the error has occurred. Here, there is a high probability that the nozzle missing occurs in the ink jet heads HD along with the designated head HD during a period after the error occurs and until the ink jet head HD, in which the error has occurred, is replaced if the ink jet heads HD that are not used along with the designated head HD are not caused to minutely vibrate during the period. This means that the probability that the nozzle missing occurs increases as the period becomes longer. That is, the probability that the error occurs increases in the ink jet heads HD in which the error has not occurred. Therefore, it is highly necessary to cause the ink jet heads HD that are not used along with the designated head HD to minutely vibration. Meanwhile, it is less necessary to cause the designated heads HD to execute minute vibration. This is because the designated head HD is the ink jet head HD that is necessary to be replaced, and power is unnecessarily consumed if the designated head HD executes minute vibration. Thus, it is possible to suppress occurrence of an error in the ink jet heads HD that are not used along with the designated head HD and to prevent unnecessary power consumption by the designated head HD by employing the setting as in the aforementioned HCU setting processing.

Note that in a case in which the HCU 501 differentiates the types of data transmitted by the output circuit 510 on the basis of the header data included in the printing data, the head control section 130 does not execute the HCU setting processing and shifts the processing from Step SA8 to Step SA10.

Returning to the description of the flowchart in FIG. 5, if the head control section 130 executes the HCU setting processing, the printer control section 100 generates printing data on the basis of the setting in the head setting region HSA (Step SA11). That is, the printer control section 100 executes the rasterization processing, the command addition processing, and the like and generates the printing data in consideration of the ink jet heads HD that are used at the time of execution of printing and the ink jet heads HD that are not used at the time of execution of printing. Note that in the case in which the HCU 501 differentiates the types of the data transmitted by the output circuit 510 on the basis of the header data included in the printing data, the printer control section 100 adds identification information of the ink jet heads HD that are not used to the header data included in the generated printing data.

Then, if the printer control section 100 generates the printing data on the basis of the setting in the head setting region HSA, the head control section 130 causes the ink jet head unit 53 to execute printing on the basis of the setting in the head setting region HSA (Step SA12).

In a case in which the setting in the head setting region HSA is the setting illustrated in FIG. 7A, for example, the head control section 130 causes the ink jet head unit 53 to execute printing without using all the ink jet heads HD that the head row HG3 has, which includes the designated head HD (the ink jet head HD63), and all the ink jet heads HD aligned on the side (the side of the head row HG4) in the direction in which the number of ink jet heads HD aligned in the extension direction of the nozzle array NR from the designated head HD is the smallest from among the ink jet heads HD that the ink jet head unit 53 has. In this manner, since the ink is not ejected from the head row HG3 including the designated head HD, the head control section 130 can prevent occurrence of unevenness in drying of the ink ejected from the head row HG3 and suppress degradation of printing quality. Further, since all the ink jet heads HD aligned on the side (the side of the head row HG4) in the direction in which the number of ink jet heads HD aligned in the extension direction of the nozzle array NR from the designated head HD is the smallest are not used, the head control section 130 can secure many ink jet heads HD to be used at the time of execution of printing and suppress degradation of the printing speed. Here, it is possible to secure more ink jet heads HD to be used in the setting illustrated in FIG. 7C as compared with the setting in FIG. 7C. However, the head row HG that is not used at the time of execution of printing is present by being pinched between the head rows HG that are used in the setting in FIG. 7C as compared with the setting in FIG. 7A. Therefore, it is assumed that generation of the printing data is not easy and takes a time in the setting in FIG. 7C as compared with the setting in FIG. 7A. Meanwhile, since the head row HG that is not used at the time of execution of printing is not pinched by the head rows HG that are used in the setting in FIG. 7A, it is assumed that the generation of the printing data is easy and does not take a time in the setting in FIG. 7A as compared with the setting in FIG. 7C. Therefore, there is a high probability that the head control section 130 can shorten the total time required for the printing by employing the setting in FIG. 7A.

In a case in which the setting in the head setting region HSA is the setting illustrated in FIG. 7B, for example, the head control section 130 causes the ink jet head unit 53 to execute printing without using all the ink jet heads HD that the head row HG3 has, which includes the designated head HD (the ink jet head HD62), and all the ink jet heads HD aligned on the upstream side of the designated head HD in the transport direction H from among the ink jet heads HD that the ink jet head unit 53 has. In a manner similar to that in FIG. 7A, since the ink is not ejected from the head row HG2 including the designated head HD, the head control section 130 can prevent occurrence of unevenness in drying of the ink ejected from the head row HG2 and suppress degradation of printing quality. Further, since all the ink jet heads HD aligned on the upstream side of the designated head HD in the transport direction H are not used, the head control section 130 uses all the ink jet heads HD aligned on the downstream side of the designated head HD in the transport direction H to execute printing. In this manner, the head control section 130 can suppress extension of the drying time of the ink ejected from the ink jet heads HD used. Therefore, the head control section 130 can reduce a difference between printing quality achieved in a case in which a part of the ink jet heads HD is not used and printing quality achieved in a case in which all the ink jet heads HD are used.

In a case in which the setting in the head setting region HSA is the setting as illustrated in FIG. 7C, the head control section 130 causes the ink jet head unit 53 to execute printing without using all the ink jet heads HD included in the head row HG 3 including the designated head HD (ink jet head HD63) from among the ink jet heads HD that the ink jet head unit 53 has. In this manner, the head control section 130 can prevent occurrence of unevenness in drying of the ink ejected from the head row HG3 since the ink is not ejected from the head row HG3 including the designated head HD. Therefore, the head control section 130 can prevent the occurrence of the unevenness in drying and suppress degradation of printing quality even in a case in which there is an ink jet head HD with an error in the ink jet head unit 53.

In a case in which the setting in the head setting region HSA is the setting illustrated in FIG. 8, for example, and in a case in which all the ink jet heads HD that the head array HR6 has, which includes the designated head HD (the ink jet head HD63), are not used, the head control section 130 causes the ink jet head unit 53 to execute printing without using the ink jet heads HD such that at least one head array HR remains for each color of the ink ejected by the ink jet head unit 53. Particularly, in the embodiment, the head control section 130 executes printing by using only the head arrays HR1 to HR4 without using the head arrays HR5 to HR8 in accordance with inhibition of use of the head array HR6. In this manner, the ink jet head unit 53 can form all the colors that can be formed by using the head arrays HR1 to HR4. Since the head arrays HR5 to HR8 do not execute ink ejection, the ink jet head unit 53 can prevent occurrence of unevenness in drying of the ink ejected from the head arrays HR5 to HR8. Therefore, the head control section 130 can prevent reliably prevent occurrence of unformed colors, further prevent occurrence of unevenness in drying, and suppress degradation of printing quality even in a case in which there is an ink jet head HD, in which the error has occurred, in the head array HR6.

Returning to the description of Step SA6 in the flowchart illustrated in FIG. 5, in a case in which the printer control section 100 determines that the low-quality setting is set as printing quality (Step SA6: "low-quality setting"), the designation section 120 designates the ink jet head HD, which is detected by the error detection section 110, in which an error has occurred, as the ink jet head HD, the use of which is inhibited at the time of execution of printing, for the head control section 130 (Step SA13).

Then, the head control section 130 causes the ink jet heads HD to execute printing without using only the designated head HD designated by the designation section 120 in Step SA13 (Step SA14). In this manner, the head control section 130 can eject the ink from the ink jet heads HD other than the designated head HD although the ink jet head unit 53 is in the state like a missing tooth. Therefore, the head control section 130 can secure more ink jet heads HD and execute printing without degrading the printing speed.

In this manner, in the case in which the high-quality setting is set as the printing quality, the head control section 130 causes the ink jet head unit 53 to execute printing without using the designated head HD and all the ink jet heads HD aligned at least on one side in the extension direction of the nozzle array NR with reference to the designated head HD. In a case in which the low-quality setting is set as the printing quality, the head control section 130 causes the ink jet head unit 53 to execute printing without using only the designated head HD. In this manner, the head control section 130 can prevent degradation of printing quality in the case in which the high-quality setting is set as the printing quality and can prevent degradation of the printing speed in the case in which the low-quality setting is set as the printing quality.

In the above description of the operations, a configuration in which the user operates the setting screen SG and the head control section 130 sets the ink jet heads HD that are not used at the time of execution of printing in accordance with the operation has been described. However, a configuration in which the head control section 130 automatically performs setting without requiring the user's operation may also be employed. In this case, the head control section 130 sets the ink jet heads HD that are not used at the time of execution of printing in accordance with a preset pattern. Effects similar to the aforementioned effects are achieved even in this case.

Although the exemplary configuration (that is, a configuration in which color printing can be performed) in which the ink jet head unit 53 has the plurality of head arrays HR for the respective colors has been described above, the ink jet head unit 53 may have one head array HR and may have a configuration in which only black (K) ink is ejected (that is, a configuration in which monochrome printing is executed).

Figure 10A:
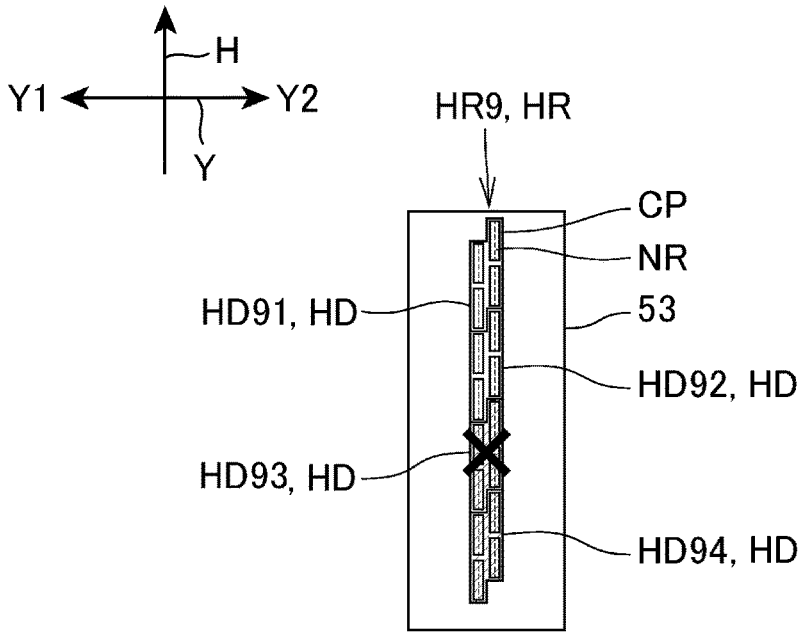
FIG. 10A is a diagram illustrating an example of a setting form.
Figure 10B:
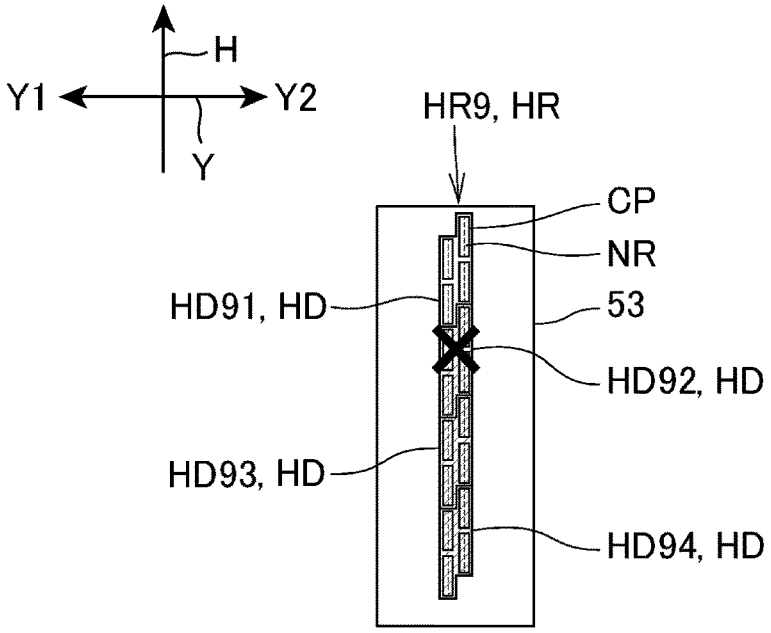
FIG. 10B is a diagram illustrating an example of the setting form.

FIGS. 10A and 10B are diagrams illustrating an example of a setting form of the ink jet heads HD that are not used at the time of execution of printing in a case in which the ink jet head unit 53 has only one head array HR.

As illustrated in FIGS. 10A and 10B, the ink jet head unit 53 with this configuration has a head array HR9 in which four ink jet heads HD for ejecting the black (K) ink are aligned in the extension direction of the nozzle array NR. The head array HR9 includes ink jet heads HD91 to HD94 in which chips CP are arranged in a zigzag manner.

FIG. 10A illustrates an example of the ink jet head HD93 with an "x" mark added thereto as the designated head HD.

As illustrated in FIG. 10A, the head control section 130 sets all the ink jet heads HD included on one side in the extension direction of the nozzle array NR with reference to the ink jet head HD93, which is the designated head HD, as the ink jet heads HD that are not used at the time of execution of printing. More specifically, the head control section 130 sets the ink jet head HD93, which is the designated head HD, and all the ink jet heads HD (ink jet heads HD94) aligned on the side in the direction in which the number of ink jet heads HD aligned in the extension direction of the nozzle array NR from the designated head HD is the smallest as the ink jet heads HD that are not used at the time of execution of printing. Effects similar to the aforementioned effects are achieved even in a case in which the ink jet head unit 53 has one head array HR as illustrated in FIG. 10A, that is, in a case in which monochrome printing is executed. Note that the ink jet heads HD that are not used at the time of execution of printing are masked with hatching to differentiate the display form for distinguishing the ink jet heads HD in FIG. 10A.

FIG. 10B illustrates an example of the ink jet head HD92 with an "x" mark added thereto as the designated head HD.

As illustrated in FIG. 10B, the head control section 130 sets all the ink jet heads HD included on one side in the extension direction of the nozzle array NR with reference to the ink jet head HD93, which is the designated head HD, as the ink jet heads HD that are not used at the time of execution of printing. More specifically, the head control section 130 sets the ink jet head HD92, which is the designated head HD, and all the ink jet heads HD (the ink jet head HD93 and the ink jet head HD94) aligned on the upstream side of the designated head HD in the transport direction H as the ink jet heads HD that are not used at the time of execution of printing. Effects similar to the aforementioned effects are achieved even in a case in which the ink jet head unit 53 has one head array HR, that is, in a case in which monochrome printing is executed as illustrated in FIG. 10B. Note that the ink jet heads HD that are not used at the time of execution of printing are masked with hatching to differentiate the display form for distinguishing the ink jet heads HD in FIG. 10B.

As described above, the printer control device 10 (printing control device) controls the printer 1 (printing apparatus) that has an ink jet head unit 53 (head unit) that has head arrays HR in which three or more ink jet heads HD (heads) for ejecting the ink from the nozzle array NR are aligned in the extension direction of the nozzle array NR (first direction) (the direction including the transport direction H and the direction opposite to the transport direction H). The printer control device 10 includes the head control section 130 (printing control section) that causes the ink jet head unit 53 to execute printing without using the designated head HD and all the ink jet heads HD aligned at least on one side in the extension direction of the nozzle array NR with reference to the designated head HD in the designation mode in which inhibition of use of the ink jet head HD is designated.

With this configuration, since the head control section 130 causes the ink jet head unit 53 to execute printing without using the designated head HD and all the ink jet heads HD aligned on one side in the extension direction of the nozzle array NR with reference to the designated head HD, no ink is ejected from the ink jet heads HD that may become a factor of unevenness in drying. Therefore, the head control section 130 can prevent occurrence of unevenness in drying and suppress degradation of printing quality.

In addition, the printer control device 10 includes the error detection section 110 that detects an error (nozzle missing) in the ink jet head HD and the designation section 120 that designates the ink jet head HD with the error as the designated head HD for the head control section 130 in a case in which the error detection section 110 detects the error.

With this configuration, the ink jet head unit 53 is caused to execute printing without using all the ink jet heads HD aligned on one side in the extension direction of the nozzle array NR with reference to the ink jet head HD with the error. Therefore, the head control section 130 can prevent occurrence of unevenness in drying due to the ink jet head HD with the error and suppress degradation of printing quality.

The head control section 130 causes the ink jet head unit 53 to execute printing without using all the ink jet heads HD aligned on the side in the direction in which the number of ink jet heads HD aligned in the extension direction of the nozzle array NR from the designated head HD is the smallest in a case in which all the ink jet heads HD aligned on one side in the extension direction of the nozzle array NR with reference to the designated head HD are not used.

With this configuration, it is possible to secure more ink jet heads HD that are used for printing, to suppress degradation of printing quality, and to suppress degradation of the printing speed in the case in which all the ink jet heads HD aligned on one side in the extension direction of the nozzle array NR with reference to the designated head HD are not used. It is possible to easily generate the printing data and to thereby shorten the time required for the generation, and the head control section 130 can shorten the total time required for printing.

The extension direction of the nozzle array NR includes the transport direction H in which the medium M is transported. The head control section 130 causes the ink jet head unit 53 to execute printing without using all the ink jet heads HD aligned on the upstream side of the designated head HD in the transport direction H in the case in which all the ink jet heads HD aligned on one side in the extension direction of the nozzle array NR with reference to the designated head HD are not used.

With this configuration, since the ink jet head unit 53 is caused to execute printing without using all the ink jet heads HD aligned on the upstream side of the designated head HD in the transport direction H in the case in which all the ink jet heads HD aligned on one side in the extension direction of the nozzle array NR with reference to the designated head HD are not used, it is possible to suppress extension of the drying time of the ink ejected from the ink jet heads HD used. Therefore, the head control section 130 can reduce the difference between the printing quality achieved in the case in which a part of the ink jet heads HD is not used and the printing quality achieved in a case in which all the ink jet heads HD are used.

The ink jet head unit 53 has the plurality of head arrays HR in the intersecting direction Y that intersects the extension direction of the nozzle array NR. The head control section 130 causes the ink jet head unit 53 to execute printing without using all the ink jet heads HD aligned in the extension direction of the nozzle array NR including the designated head HD and all the ink jet heads HD aligned on one side in the intersecting direction Y with reference to the designated head HD.

With this configuration, since the head control section 130 causes the ink jet head unit 53 to execute printing without using the head array HR including the designated head HD and all the ink jet heads HD aligned on one side in the intersecting direction Y with reference to the designated head HD, no ink is ejected from the ink jet heads HD that may become a factor of unevenness in drying. Therefore, the head control section 130 can prevent occurrence of unevenness in drying and suppress degradation of printing quality.

The ink jet head unit 53 has the plurality of head arrays HR for the respective colors. The head control section 130 causes the ink jet head unit 53 to execute printing without using all the ink jet heads HD such that at least one head array HR remains for each color in the case in which all the ink jet heads HD (all the ink jet heads HD that the head array HR has, which includes the designated head HD) aligned in the extension direction of the nozzle array NR including the designated head HD are not used.

With this configuration, since the ink jet head unit 53 is caused to execute printing without using the ink jet heads HD such that at least one head array HR remains for each color in the case in which all the ink jet heads HD included in the head array HR including the designated head HD are not used, it is possible to prevent occurrence of unformed colors, to prevent occurrence of unevenness in drying, and to suppress degradation of printing quality.

The head control section 130 causes the ink jet head unit 53 to execute printing without using the designated head HD and all the ink jet heads HD aligned at least on one side in the extension direction of the nozzle array NR with reference to the designated head HD in the case in which the high-quality setting (first setting) is set as the printing quality in the designation mode, and the head control section 130 causes the ink jet head unit 53 to execute printing without using only the designated head HD in the case in which the low-quality setting (second setting) is set as the printing quality in the designation mode.

With this configuration, since the head control section 130 causes printing to be executed without using the designated head HD and all the ink jet heads HD aligned at least on one side in the extension direction of the nozzle array NR with reference to the designated head HD in the case in which the high-quality setting is set as the printing quality, and the head control section 130 causes printing to be executed without using only the designated head HD in the case in which the low-quality setting is set, it is possible to suppress degradation of printing quality and degradation of the printing speed in accordance with the set printing quality.

The ink jet heads HD include the piezoelectric elements (drive elements) that eject the ink from the nozzles that form the nozzle array NR. The head control section 130 causes at least the piezoelectric elements included in the ink jet heads HD that are not used other than the designated head HD to minutely vibrate.

With this configuration, since at least the piezoelectric elements included in the ink jet heads HD that are not used other than the designated head HD are caused to minutely vibrate, it is possible to suppress occurrence of an error in the ink jet heads HD that are not used other than the designated head HD and to suppress an increase in the ink jet heads HD in which an error has occurred.

Note that the aforementioned respective embodiments illustrate only aspects of the invention, and modifications and applications can be arbitrarily made within a scope of the invention.

Although the exemplary configuration in which the printer control device 10 is provided in the printer 1 is described in the aforementioned embodiments, for example, the printer control device 10 may be provided as a separate body from the printer 1 and outside the printer 1. In this case, the printer control device 10 functions as an external device that is dedicated for the generation of printing data.

The ink ejected from the nozzles that are included in the nozzle array NR may be resin ink or solvent ink, for example. Since the resin ink or the solvent ink tends not to soak into the medium M as compared with dye ink and is fixed to the surface of the medium M, unevenness of drying tends to appear. Further, when eco-solvent is used, heat of an external heater is further added to dry ink in a short period of time, and unevenness in drying further tends to appear. Therefore, it is possible to prevent occurrence of unevenness in drying even with such ink by applying the invention.

The functions of the aforementioned respective functional blocks in the printer control section 100 can be realized in forms of a storage medium that stores programs, a server apparatus that distributes the programs, a transmission medium that transmits the programs, data signals that realize the programs in transport waves, and the like. Various computer-readable media can be utilized as the storage medium, and any of a magnetic storage medium, an optical storage medium, and a semiconductor memory device may be used, or another type of storage medium may be used. The storage medium may be a mobile storage medium such as a memory card. The storage medium may be a storage medium included in an apparatus connected to the aforementioned device via a communication line. The programs can be mounted as application programs that operate along on an operating system of an apparatus that mounts the operating system and operates. The programs are not only mounted on application programs that operate alone but may also be mounted as a plurality of functions of an operating system, a device driver, and application programs. For example, a configuration in which the aforementioned programs are realized by a device driver program that controls an operation device including an operation surface and/or a program module that receives operations performed on the operation device in the operating system in cooperation with each other. A configuration in which the aforementioned programs according to the invention are realized by the plurality of application programs may be employed, and the programs may have arbitrary specific forms.

In a case in which the aforementioned method of controlling the printer control device 10 (the control method of the printing control device) is realized by using a computer included in the printer control device 10, for example, it is possible to realize the invention in a form of programs executed by the computer to realize the aforementioned control method, a recording medium that records the program in a computer-readable manner, or a transmission medium that transmits the program.

Specifically, a mobile or stationary recording medium such as a flexible disk, a hard disk drive (HDD), a compact disk read only memory (CD-ROM), a digital versatile disk (DVD), Blu-ray (registered trademark) disc, a magneto-optic disc, a flash memory, or a card-type recording medium is exemplified. The aforementioned recording medium may be a nonvolatile storage device such as a random access memory (RAM), a read only memory (ROM), or an HDD that is an internal storage device included in the printer control device 10.

The processing units in FIGS. 5 and 9 are obtained by dividing main processing content for easily understanding the processing performed by the printer control device 10, for example, and the invention is not limited by how to divided the processing units and names of the processing units. The processing performed by the printer control device 10 may be divided into more processing units in accordance with the processing content. Alternatively, the processing may be divided such that one processing unit includes more processing.

The respective functional parts illustrated in FIG. 3 illustrates the functional configuration, and the specific implementation form is not particularly limited thereto. That is, it is not always necessary to mount hardware that individually corresponds to the respective functional parts, and it is a matter of course that one processor can realize functions of a plurality of functional parts by executing a program. Also, a part of the functions realized by software in the aforementioned embodiments may be realized by hardware, or alternatively, a part of functions realized by hardware may be realized by software. In addition, change can arbitrarily added to the specific detailed configurations of other respective parts in the printer 1 without departing from the gist of the invention.

What is claimed is:

1. A printing control device that controls a printing apparatus provided with a head unit that has head arrays, in which three or more heads for ejecting ink from nozzle arrays are aligned in a first direction that is a nozzle array extending direction, the device comprising:

a printing control section that causes the head unit to execute printing without using a designated head that is a head designated and all heads aligned at least on one side in the first direction with reference to the designated head, in a designation mode in which inhibition of use of the head is designated, wherein in a case in which all the heads aligned on one side in the first direction with reference to the designated head are not used, the printing control section causes the head unit to execute printing without using all the heads aligned on the one side in the first direction, the number of which aligned in the first direction from the designated head is the smallest.

2. The printing control device according to claim 1, further comprising:

an error detection section that detects an error in the heads; and a designation section that designates the head with the error as the designated head for the printing control section in a case in which the error detection section detects the error.

3. The printing control device according to claim 1, wherein the first direction includes a transport direction in which a printing medium is transported, and wherein in a case in which all the heads aligned on the one side in the first direction with reference to the designated head are not used, the printing control section causes the head unit to execute printing without using all the heads aligned on an upstream side of the designated head in the transport direction.

4. The printing control device according to claim 1, wherein the head unit has a plurality of head arrays aligned in a second direction that intersects the first direction, and wherein the printing control section causes the head unit to execute printing without using all the heads aligned in the first direction including the designated head and all the heads aligned on one side in the second direction with reference to the designated head.

5. The printing control device according to claim 4, wherein the head unit has the plurality of head arrays for each color, and wherein in a case in which all the heads aligned in the first direction including the designated head and all the heads aligned on one side in the second direction with reference to the designated head are not used, the printing control section causes the head unit to execute printing without using the heads such that at least one head array remains for each color.

6. The printing control device according to claim 1, wherein in a case in which printing quality is in first setting in the designation mode, the printing control section causes the head unit to execute printing without using all the heads aligned at least on one side in the first direction with reference to the designated head, and wherein in a case in which the printing quality is in second setting that is lower than the first setting in the designation mode, the printing control section causes the head unit to execute printing without using only the designated head.

7. The printing control device according to claim 1, wherein the heads include drive elements that cause ink to be ejected from nozzles that form the nozzle arrays, and wherein the printing control section causes at least the drive elements provided in the heads, which are not used, other than the designated head to minutely vibrate.

8. A printing apparatus comprising:

a head unit that has head arrays, in which three or more heads for ejecting ink from nozzle arrays are aligned in a first direction that is a nozzle array extending direction; and a printing control device that has a printing control section that causes the head unit to execute printing without using a designated head that is a head designated and all heads aligned at least on one side in the first direction with reference to the designated head, in a designation mode in which inhibition of use of the head is designated, wherein in a case in which all the heads aligned on one side in the first direction with reference to the designated head are not used, the printing control section causes the head unit to execute printing without using all the heads aligned on the one side in the first direction, the number of which aligned in the first direction from the designated head is the smallest.

9. A control method of a printing control device that controls a printing apparatus provided with a head unit that has head arrays, in which three or more heads for ejecting ink from nozzle arrays are aligned in a first direction that is a nozzle array extending direction, the method comprising:

causing the head unit to execute printing without using a designated head that is a head designated and all heads aligned at least on one side in the first direction with reference to the designated head, in a designation mode in which inhibition of use of the head is designated, and causing, in a case in which all the heads aligned on one side in the first direction with reference to the designated head are not used, the head unit to execute printing without using all the heads aligned on the one side in the first direction, the number of which aligned in the first direction from the designated head is the smallest.

10. A non-transitory tangible computer-readable medium for storing a program which, when executed by a control section of a printing control device that controls a printing apparatus provided with a head unit that has head arrays, in which three or more heads for ejecting ink from nozzle arrays are aligned in a first direction that is a nozzle array extending direction, causes the control section to:

cause the head unit to execute printing without using a designated head that is a head designated and all heads aligned on at least one side in the first direction with reference to the designated head, in a designation mode in which inhibition of use of the head is designated, and cause, in a case in which all the heads aligned on one side in the first direction with reference to the designated head are not used, the head unit to execute printing without using all the heads aligned on the one side in the first direction, the number of which aligned in the first direction from the designated head is the smallest.

* * * * *